US011508287B2

(12) United States Patent
Kim et al.

(10) Patent No.: US 11,508,287 B2
(45) **Date of Patent: *Nov. 22, 2022**

(54) DISPLAY PANEL AND DRIVING METHOD OF THE DISPLAY PANEL

(71) Applicant: SAMSUNG ELECTRONICS CO., LTD., Suwon-si (KR)

(72) Inventors: Jinho Kim, Suwon-si (KR); Sangmin Shin, Suwon-si (KR); Youngki Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/399,101

(22) Filed: Aug. 11, 2021

(65) Prior Publication Data

US 2021/0375185 A1 Dec. 2, 2021

Related U.S. Application Data

(63) Continuation of application No. 16/832,923, filed on Mar. 27, 2020, now Pat. No. 11,100,840.

(30) Foreign Application Priority Data

Mar. 29, 2019 (KR) ..... 10-2019-0037302
Aug. 26, 2019 (KR) ..... 10-2019-0104727
Oct. 14, 2019 (KR) ..... 10-2019-0127305

(51) Int. Cl.
*G09G 3/20* (2006.01)
*G09G 3/32* (2016.01)

(52) U.S. Cl.
CPC ..... *G09G 3/2081* (2013.01); *G09G 3/2011* (2013.01); *G09G 3/2014* (2013.01);
(Continued)

(58) Field of Classification Search
CPC .... H05B 45/325; H05B 45/33; G09G 3/2011; G09G 3/2014; G09G 3/2081; G09G 3/32;
(Continued)

(56) References Cited

U.S. PATENT DOCUMENTS 7,167,169 B2 1/2007 Libsch et al.
7,808,497 B2 10/2010 Lo et al.
(Continued)

FOREIGN PATENT DOCUMENTS

CN 101656049 B 11/2012
JP 2000-39868 A 2/2000
(Continued)

OTHER PUBLICATIONS

Communication dated Oct. 7, 2021, issued by the European Patent Office in counterpart European Application No. 20784014.1.
(Continued)

*Primary Examiner* — Sanjiv D. Patel
(74) *Attorney, Agent, or Firm* — Sughrue Mion, PLLC

(57) ABSTRACT

A display panel including a plurality of pixels is provided. The display panel includes: a plurality of light emitting elements configured to constitute each pixel of the plurality of pixels; and a plurality of pixel circuits respectively corresponding to the plurality of light emitting elements and configured to drive the plurality of light emitting elements, wherein the plurality of pixel circuits includes a first pixel circuit for pulse width modulation (PWM)-driving a first light emitting element among the plurality of light emitting elements and a second pixel circuit for pulse amplitude modulation (PAM)-driving a second light emitting element among the plurality of light emitting elements.

26 Claims, 21 Drawing Sheets

(52) U.S. Cl.
CPC ..... *G09G 3/32* (2013.01); *G09G 2320/0242* (2013.01); *G09G 2320/064* (2013.01); *G09G 2320/0633* (2013.01)

(58) Field of Classification Search
CPC ..... G09G 2320/064; G09G 2300/0452; G09G 3/2018; G09G 2310/08; G09G 2320/0633; G09G 3/3233; G09G 3/3225; G09G 3/3208; G09G 3/3258
See application file for complete search history.

(56) References Cited

U.S. PATENT DOCUMENTS

| | | | |
|---|---|---|---|
| 7,948,454 | B2 | 5/2011 | Biwa |
| 9,099,045 | B2 | 8/2015 | Ueda et al. |
| 9,666,656 | B2 | 5/2017 | Tomida |
| 2001/0019319 | A1 | 9/2001 | Kim |
| 2003/0197666 | A1 | 10/2003 | Akimoto et al. |
| 2008/0018632 | A1 | 1/2008 | Cordes et al. |
| 2011/0096239 | A1 | 4/2011 | Burns et al. |
| 2011/0169878 | A1 | 7/2011 | Chung et al. |
| 2012/0113083 | A1 | 5/2012 | Kim |
| 2017/0229524 | A1 | 8/2017 | Tomida |
| 2017/0263183 | A1 | 9/2017 | Lin et al. |
| 2018/0158398 | A1 | 6/2018 | Xiang et al. |
| 2018/0293929 | A1 | 10/2018 | Shigeta et al. |
| 2018/0301080 | A1 | 10/2018 | Shigeta |
| 2019/0335553 | A1 | 10/2019 | Ahmed |

FOREIGN PATENT DOCUMENTS

| | | | |
|---|---|---|---|
| JP | 2008-277865 | A | 11/2008 |
| JP | 4435123 | B2 | 3/2010 |
| KR | 10-0780321 | B1 | 11/2007 |
| KR | 10-2013-0053536 | A | 5/2013 |
| KR | 10-1524308 | B1 | 5/2015 |
| KR | 10-2016-0036385 | A | 4/2016 |
| KR | 10-2018-0043056 | A | 4/2018 |

OTHER PUBLICATIONS

International Search Report (PCT/ISA/210) dated Jul. 9, 2020 issued by the International Searching Authority in International Application No. PCT/KR2020/004205.
Written Opinion (PCT/ISA/237) dated Jul. 9, 2020 issued by the International Searching Authority in International Application No. PCT/KR2020/004205.
Communication dated Apr. 19, 2022 by the European Patent Office in counterpart European Patent Application No. 20784014.1.
Communication dated Sep. 23, 2022, issued by the European Patent Office in counterpart European Application No. 20784014.1.

DISPLAY PANEL AND DRIVING METHOD OF THE DISPLAY PANEL

CROSS-REFERENCE TO RELATED APPLICATION(S)

This application is a continuation application of U.S. patent application Ser. No. 16/832,923, filed Mar. 27, 2020, which is based on and claims priority under 35 U.S.C. § 119 to Korean Patent Application No. 10-2019-0037302, filed on Mar. 29, 2019, Korean Patent Application No. 10-2019-0104727, filed on Aug. 26, 2019, and Korean Patent Application No. 10-2019-0127305, filed on Oct. 14, 2019, in the Korean Intellectual Property Office, the disclosures of which are incorporated herein in their entirety by reference.

BACKGROUND

Field

The disclosure relates to a display panel and a driving method of the display panel, and more particularly, to a display panel in which a light emitting element constitutes a pixel, and a driving method of the display panel.

Description of the Related Art

In recent years, a display panel for displaying an image through light emitting elements such as a red light emitting diode (LED), a green LED, and a blue LED has been developed. Each pixel of such a display panel may include a plurality of sub-pixels, and each sub-pixel includes a light emitting element. In this case, the light emitting element may be implemented as a micro LED.

In such a display panel, when gray scale of the sub-pixel is expressed through a pulse amplitude modulation (PAM) driving manner, because a wavelength as well as the gray scale of light emitted according to amplitude of a driving current change together, there is a problem that color reproducibility of an image is reduced. FIG. 1 illustrates a change in wavelength according to the magnitude (or amplitude) of a driving current flowing through a blue LED, a green LED, and a red LED.

In addition, when the sub-pixel is implemented through the light emitting element, a pixel circuit for driving the sub-pixel is required for each light emitting element. In this case, if the pixel circuit occupies a large area in the display panel, there is a problem that a high resolution display panel may not be provided.

SUMMARY

Provided are a display panel and a driving method thereof that may provide a high resolution display panel while improving color reproducibility by optimizing a design of a driving circuit for driving an LED, which is an inorganic light emitting element, mounted on a substrate, with respect to an input image signal.

Further, provided are a display panel and a driving method thereof capable of securing a range of PWM data voltage capable of stably expressing gray scale.

Additional aspects will be set forth in part in the description which follows and, in part, will be apparent from the description, or may be learned by practice of the presented embodiments.

In accordance with an aspect of the disclosure, a display panel including a plurality of pixels includes: a plurality of light emitting elements configured to constitute each pixel of the plurality of pixels; and a plurality of pixel circuits respectively corresponding to the plurality of light emitting elements and configured to drive the plurality of light emitting elements, wherein the plurality of pixel circuits includes a first pixel circuit for pulse width modulation (PWM)-driving a first light emitting element among the plurality of light emitting elements and a second pixel circuit for pulse amplitude modulation (PAM)-driving a second light emitting element among the plurality of light emitting elements.

The plurality of light emitting elements may include a red (R) light emitting element, a green (G) light emitting element, and a blue (B) light emitting element; the first light emitting element may correspond to the green light emitting element; and the second light emitting element may correspond to the red light emitting element and the blue light emitting element.

A size of the first pixel circuit may be greater than a size of the second pixel circuit.

Each of the plurality of light emitting elements may be configured to emit light based on a driving current provided from a corresponding pixel circuit among the plurality of pixel circuits; the first pixel circuit may be configured to provide, to the first light emitting element for a time corresponding to a PWM data voltage applied to the first pixel circuit, a first driving current having an amplitude corresponding to a first PAM data voltage applied to the first pixel circuit; and the second pixel circuit may be configured to provide, to the second light emitting element, a second driving current having an amplitude corresponding to a second PAM data voltage applied to the second pixel circuit.

A gray scale of light emitted from the first light emitting element may be controlled by a time when the first driving current is provided to the first light emitting element according to a magnitude of the PWM data voltage; and a gray scale of light emitted from the second light emitting element may be controlled by the amplitude of the second driving current according to a magnitude of the second PAM data voltage.

Each of the plurality of light emitting elements may be a micro light emitting diode (LED).

The first pixel circuit may be configured to change a voltage of a terminal of the first pixel circuit according to a sweep voltage applied to the first pixel circuit to provide, to the first light emitting element, a driving current having a pulse width corresponding to a PWM data voltage; and the sweep voltage may be a voltage that is linearly changed from a second voltage after changing from a first voltage to the second voltage.

The first pixel circuit may include a transistor and may be configured to control the pulse width of the driving current by performing a switching operation of the transistor based on a voltage of a gate terminal of the transistor that is changed according to the sweep voltage.

The sweep voltage may be a voltage that is stepped up from the first voltage to the second voltage before an emission time of the first light emitting element, and then decreases with time from the second voltage during the emission time.

The voltage of the gate terminal of the transistor may increase by a difference between the second voltage and the first voltage as the sweep voltage increases, and may decrease from the increased voltage as the sweep voltage decreases; and the pulse width of the driving current may be determined based on a time until the decreased voltage of the gate terminal reaches a specific voltage.

The specific voltage may be a voltage determined based on a driving voltage for driving the first pixel circuit.

The difference between the first voltage and the second voltage may correspond to a range of the PWM data voltage for expressing the gray scale of the light emitted from a first inorganic light emitting element.

The first pixel circuit may be configured to turn on a transistor connected in parallel with a first inorganic light emitting element in a time section including a time point at which a switching operation of the transistor is performed, in order to discharge a leakage current.

In accordance with another aspect of the disclosure, a driving method of a display panel in which each of a plurality of pixels includes a plurality of light emitting elements and includes a plurality of pixel circuits respectively corresponding to the plurality of light emitting elements for driving the plurality of light emitting elements, includes: pulse width modulation (PWM)-driving a first light emitting element among the plurality of light emitting elements through a first pixel circuit; and pulse amplitude modulation (PAM)-driving a second light emitting element among the plurality of light emitting elements through a second pixel circuit.

The plurality of light emitting elements may include a red (R) light emitting element, a green (G) light emitting element, and a blue (B) light emitting element; the first light emitting element may correspond to the green light emitting element; and the second light emitting element may correspond to the red light emitting element and the blue light emitting element.

A size of the first pixel circuit may be greater than a size of the second pixel circuit.

Each of the plurality of light emitting elements may emit light based on a driving current provided from a corresponding pixel circuit among the plurality of pixel circuits; the PWM-driving may include providing, by the first pixel circuit to the first light emitting element for a time corresponding to a PWM data voltage applied to the first pixel circuit, a first driving current having an amplitude corresponding to a first PAM data voltage applied to the first pixel circuit; and the PAM-driving may include providing, by the second pixel circuit to the second light emitting element, a second driving current having an amplitude corresponding to a second PAM data voltage applied to the second pixel circuit.

A gray scale of light emitted from the first light emitting element may be controlled by a time when the first driving current is provided to the first light emitting element according to a magnitude of the PWM data voltage; and a gray scale of light emitted from the second light emitting element may be controlled by the amplitude of the second driving current according to a magnitude of the second PAM data voltage.

Each of the plurality of light emitting elements may be a micro LED.

The PWM-driving may include changing, by the first pixel circuit, a voltage of a terminal of the first pixel circuit according to a sweep voltage applied to the first pixel circuit to provide, to the first light emitting element, a driving current having a pulse width corresponding to a PWM data voltage; and the sweep voltage may be a voltage that is linearly changed from a second voltage after changing from a first voltage to the second voltage.

The PWM-driving may further include controlling, by the first pixel circuit, the pulse width of the driving current by performing a switching operation of a transistor, of the first pixel circuit, based on a voltage of a gate terminal of the transistor that is changed according to the sweep voltage.

The sweep voltage may be a voltage that is stepped up from the first voltage to the second voltage before an emission time of the first light emitting element, and then decreases with time from the second voltage during the emission time.

The voltage of the gate terminal of the transistor may increase by a difference between the second voltage and the first voltage as the sweep voltage increases, and decrease from the increased voltage as the sweep voltage decreases; and the pulse width of the driving current may be determined based on a time until the decreased voltage of the gate terminal reaches a specific voltage.

The specific voltage may be a voltage determined based on a driving voltage for driving the first pixel circuit.

The difference between the first voltage and the second voltage may correspond to a range of the PWM data voltage for expressing the gray scale of the light emitted from a first inorganic light emitting element.

The PWM-driving may include turning on, by the first pixel circuit, a transistor connected in parallel with a first inorganic light emitting element in a time section including a time point at which a switching operation of the transistor is performed, in order to discharge a leakage current.

In accordance with another aspect of the disclosure, a plurality of pixel circuits respectively corresponding to a plurality of light-emitting elements constituting a pixel, includes: a first pixel circuit configured to pulse width modulation (PWM)-drive a first light emitting element among the plurality of light emitting elements; and a second pixel circuit configured to pulse amplitude modulation (PAM)-drive a second light emitting element among the plurality of light emitting elements.

The first pixel circuit may be configured to PWM-drive a green light emitting element; and the second pixel circuit may be configured to PAM-drive a red light emitting element and a blue light emitting element.

A size of the first pixel circuit may be greater than a size of the second pixel circuit.

The first pixel circuit may be configured to provide, to the first light emitting element for a time corresponding to a PWM data voltage applied to the first pixel circuit, a first driving current having an amplitude corresponding to a first PAM data voltage applied to the first pixel circuit; and the second pixel circuit may be configured to provide, to the second light emitting element, a second driving current having an amplitude corresponding to a second PAM data voltage applied to the second pixel circuit.

Each of the plurality of light emitting elements may be a micro light emitting diode (LED).

The first pixel circuit may be configured to change a voltage of a terminal of the first pixel circuit according to a sweep voltage applied to the first pixel circuit to provide, to the first light emitting element, a driving current having a pulse width corresponding to a PWM data voltage; and the sweep voltage may be a voltage that is linearly changed from a second voltage after changing from a first voltage to the second voltage.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Hereinafter, detailed descriptions for known components or operations related to embodiments may be omitted. In addition, redundant descriptions of the same or similar structures or operations may be omitted.

The suffix "~er" for components used in the following description may be provided for each of description, and may not in itself have distinct meanings or roles.

Terms used in the specification are used to describe embodiments, and are not intended to restrict and/or limit the disclosure. Singular expressions include plural expressions unless the context clearly indicates otherwise.

It should be further understood that terms "include" or "have" used in the disclosure specify the presence of features, numerals, steps, operations, components, parts mentioned in the specification, or combinations thereof, but do not preclude the presence or addition of one or more other features, numerals, steps, operations, components, parts, or combinations thereof.

Expressions "first," "second," and the like, used in the disclosure may indicate various components regardless of a sequence and/or importance of the components, will be used in order to distinguish one component from the other components, and do not limit the corresponding components.

When it is mentioned that any component (for example, a first component) is (operatively or communicatively) coupled with/to or is connected to another component (for example, a second component), it is to be understood that the component is directly coupled with/to the other component or may be coupled with/to the other component through an intervening component (for example, a third component). On the other hand, when it is mentioned that any component (for example, a first component) is "directly coupled with/to" or "directly connected to" another component (for example, a second component), it is to be understood that an intervening component (for example, a third component) is not present between the component and the other component.

Unless otherwise defined, terms used in the detailed description may be interpreted as meanings commonly known to those skilled in the art.

It is understood that, as used herein, expressions such as "at least one of," when preceding a list of elements, modify the entire list of elements and do not modify the individual elements of the list. For example, the expressions "at least one of [A], [B], and [C]" or "at least one of [A], [B], or [C]" means only A, only B, only C, A and B, B and C, A and C, or A, B, and C.

Hereinafter, various embodiments will be described in detail with reference to the accompanying drawings.

Figure 2:
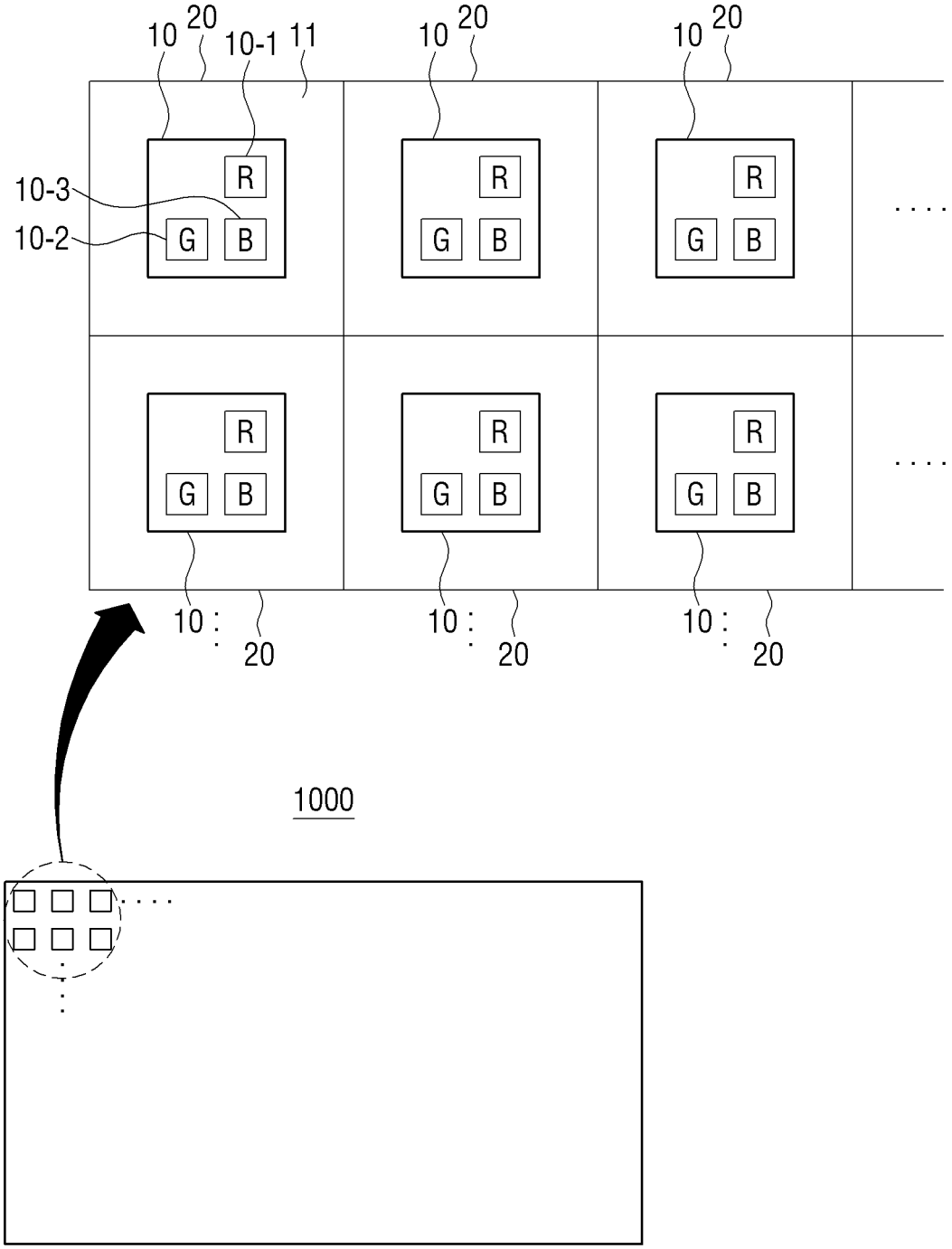
FIG. 2 is a diagram for describing a pixel structure of a display panel according to an embodiment.

FIG. 2 is a diagram for describing a pixel structure of a display panel (or a display module) 1000 according to an embodiment.

Here, a display panel according to an embodiment may be applied to a wearable device, a portable device, a handheld device, and an electronic product or an electronic device including various displays in a single unit.

Also, the display panel according to an embodiment may be applied to a display device through a plurality of assembly arrangements in a matrix form. In this case, for example, the display panel comprises a monitor for a personal computer, a (high definition) television (TV), a large display device such as a signage, an electronic display, and the like.

As illustrated in FIG. 2, the display panel 1000 may include a plurality of pixels 10 arranged in a matrix form.

In this case, each pixel 10 may include a plurality of sub-pixels 10-1 to 10-3. For example, one pixel 10 of the display panel 1000 may include three types of sub-pixels such as a red (R) sub-pixel 10-1, a green (G) sub-pixel 10-2, and a blue (B) sub-pixel 10-3. That is, one set of the R sub-pixel, the G sub-pixel, and the B sub-pixel may constitute one unit pixel of the display panel 1000.

Each sub-pixel may include a light emitting element. Here, the light emitting element may be an inorganic light emitting element manufactured using an inorganic material, which is different from an organic light emitting diode (OLED) manufactured using an organic material. Specifically, the light emitting element may be a light emitting diode (LED), in particular, a micro LED (u-LED or micro-LED). The micro LED refers to an ultra-small inorganic light emitting element having a size of 100 micrometers (μm) or less that emits light itself without a backlight or color filter.

Accordingly, the R sub-pixel may include an R micro LED, the G sub-pixel may include a G micro LED, and the B sub-pixel may include a B micro LED.

Referring to FIG. 2, the R, G, and B sub-pixels 10-1 to 10-3 are illustrated as being arranged in a reversed L shape in one pixel 10, but this is merely an example. It is understood that, in various embodiments, the sub-pixels 10-1 to 10-3 may be arranged in various forms.

Figure 3:
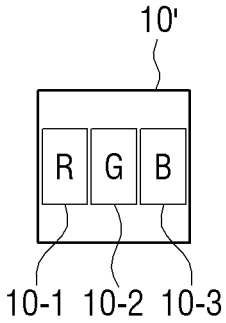
FIG. 3 is a diagram for describing a pixel structure of a display panel according to an embodiment.

For example, as illustrated in FIG. 3, the R, G, and B sub-pixels 10-1 to 10-3 may be arranged in a line in a pixel 10' according to another embodiment. However, such an arrangement of the sub-pixels is also merely an example, and the plurality of sub-pixels may be arranged in various forms within each pixel according to various embodiments.

Further, in the above example, the pixel has been described as including the three types of sub-pixels, that is, the R, G, and B sub-pixels. It is understood, however, that one or more other embodiments are not limited thereto. For example, the pixel may be implemented as four types of sub-pixels such as R, G, B, and W (white), or may further include any other kind of sub-pixel.

Moreover, referring to FIG. 2, in the display panel 1000, one pixel region 20 may include a region 10 occupied by the pixel and a remaining region 11 around the pixel.

In this case, the region 10 occupied by the pixel may be regarded as a region occupied by the plurality of sub-pixels constituting the pixel and a driving circuit for driving each sub-pixel.

That is, the region 10 occupied by the pixel may include an R light emitting element and a pixel circuit for driving the R light emitting element, a G light emitting element and a pixel circuit for driving the G light emitting element, and a B light emitting element and a pixel circuit for driving the B light emitting element. Meanwhile, the remaining region 11 may include various circuits for driving the pixel circuit.

Figure 4:
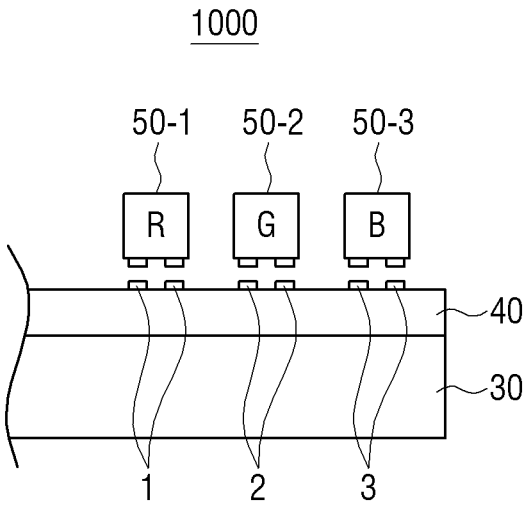
FIG. 4 is a cross-sectional view of the display panel according to an embodiment.

The pixel circuit may be formed on a substrate of the display panel 1000. Specifically, FIG. 4 is a cross-sectional view of the display panel according to an embodiment. In FIG. 4, for convenience of description, only one pixel included in the display panel 1000 is illustrated, and it is illustrated that sub-pixels in the pixel are arranged in a line.

Referring to FIG. 4, the display panel 1000 may include a substrate 30, a driving circuit layer 40, and R, G, and B light emitting elements 50-1 to 50-3.

In this case, pixel circuits for driving the light emitting elements 50-1, 50-2, 50-3 may be implemented with a thin film transistor (TFT) and a capacitor, and may be included in the driving circuit layer 40 formed on the substrate 30. That is, the driving circuit layer 40 may include a pixel circuit for driving an R light emitting element 50-1, a pixel circuit for driving a G light emitting element 50-2, and a pixel circuit for driving a B light emitting element 50-3.

Further, the substrate 30 may be implemented with glass, and the display panel 1000 in which the driving circuit layer 40 and the light emitting elements 50-1 to 50-3 are formed on the glass may be referred to as a display panel of a chip on glass (COG) type. In this case, the glass and the driving circuit layer 40 formed on the glass may be collectively called a TFT panel or a glass substrate. However, this is merely an example, and the substrate may be implemented with various materials in various embodiments.

The TFT of a TFT layer (or a backplane) is not limited to a specific structure or type. In other words, the TFT of the disclosure may be implemented as oxide TFT and Si TFT (poly silicon, a-silicon), organic TFT, graphene TFT, etc. other than LTPS TFT, and in the process of Si wafer CMOS, only P type (or N-type) MOSFET can be made and applied.

In addition, the R, G, and B light emitting elements 50-1 to 50-3 may be disposed on the driving circuit layer 40. In this case, the light emitting element may be mounted or disposed on the driving circuit layer 40 to be electrically connected to the pixel circuit.

For example, the R light emitting element 50-1 may be electrically connected to an electrode 1 formed or provided on the pixel circuit for driving the R light emitting element 50-1, the G light emitting element 50-2 may be electrically connected to an electrode 2 formed or provided on the pixel circuit for driving the G light emitting element 50-2, and the B light emitting element 50-3 may be electrically connected to an electrode 3 formed or provided on the pixel circuit for driving the B light emitting element 50-3.

Meanwhile, the light emitting elements 50-1 to 50-3 may be implemented as flip chip type micro LEDs. However, the light emitting elements 50-1 to 50-3 are not limited thereto, and in some embodiments, the light emitting elements 50-1 to 50-3 may be lateral type or vertical type micro LEDs.

Moreover, according to an embodiment, the display panel 1000 may further include at least one of a mux circuit for selecting any one of the plurality of sub-pixels 10-1 to 10-3 constituting the pixel 10, an electrostatic discharge circuit (ESD) for preventing static electricity generated in the display panel 1000, at least a gate driver for driving the pixels arranged in a matrix form on the display panel 1000 in a horizontal line unit (or row unit), a data driver (or source driver) for providing a data voltage (for example, a pulse amplitude modulation (PAM) data voltage, a pulse width modulation (PWM) data voltage, or the like) to each pixel or each sub-pixel, and the like.

Figure 5:
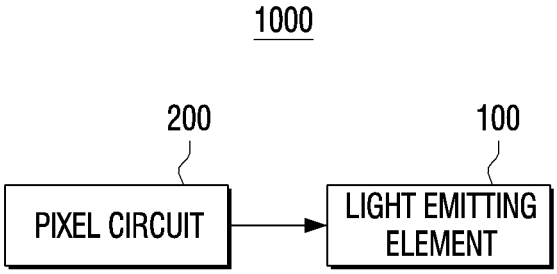
FIG. 5 is a block diagram illustrating a configuration of the display panel according to an embodiment.

FIG. 5 is a block diagram illustrating a configuration of the display panel 1000 according to an embodiment.

Referring to FIG. 5, the display panel 1000 may include a light emitting element 100 and a pixel circuit 200.

The light emitting element 100 constitutes the sub-pixel of the display panel 1000. Specifically, the display panel 1000 may include a plurality of pixels arranged in a matrix form, and each pixel may include a plurality of sub-pixels. Accordingly, a plurality of light emitting elements 100 may be included for each pixel.

In this case, the display panel 1000 may include a plurality of types of light emitting elements 100, and the type of the sub-pixel may be determined according to the type of the light emitting element 100.

Specifically, the display panel 1000 may include a red (R) light emitting element for emitting red light, a green (G) light emitting element for emitting green light, and a blue (B) light emitting element for emitting blue light. In this case, the pixel of the display panel 1000 includes R, G, and B sub-pixels. The R light emitting element may constitute the R sub-pixel, the G light emitting element may constitute the G sub-pixel, and the B light emitting element may constitute the B sub-pixel.

On the other hand, the light emitting element 100 may be a micro LED. In this case, the R sub-pixel may include an R micro LED, the G sub-pixel may include a G micro LED, and the B sub-pixel may include a B micro LED.

Further, the light emitting element 100 may emit light according to a driving current provided by the pixel circuit 200.

Specifically, the light emitting element 100 may emit light with different luminance according to amplitude or a pulse width of the driving current provided by the pixel circuit 200. Here, the pulse width of the driving current may also be expressed as a duty ratio of the driving current or a driving time (or duration) of the driving current.

For example, the light emitting element 100 may emit light with high luminance as the amplitude of the driving current is larger and may emit light with high luminance as the pulse width is longer (i.e., the duty ratio is higher or the driving time is longer), but is not limited thereto.

The pixel circuit 200 may drive the light emitting element 100. Specifically, the pixel circuit 200 may drive the light emitting element 100 to control a gray scale of the light emitted from the light emitting element 100. In this case, according to an embodiment, depending on the type of light emitting element, a specific type of light emitting element may be driven through a pixel circuit for PWM driving, and other types of light emitting elements may be driven through a pixel circuit for PAM driving. Details thereof are described below.

Meanwhile, according to an embodiment, the pixel circuit 200 may drive the light emitting element 100 to express the gray scale in a unit of the sub-pixel. As described above, because the display panel 1000 has the sub-pixel configured in a unit of the light emitting element 100, the pixel circuit 200 may drive the light emitting element 100 to express the gray scale in a unit of the sub-pixel, unlike a liquid crystal display (LCD) panel, which uses a plurality of LEDs that emit light of the same single color as a backlight.

To this end, each sub-pixel of the display panel 1000 may include the light emitting element 100 and the pixel circuit 200 for driving the light emitting element 100. That is, for each light emitting element 100, there may be a pixel circuit 200 for driving the light emitting element 100. Specifically, the display panel 1000 may include, for each pixel, a pixel circuit for driving the R light emitting element, a pixel circuit for driving the G light emitting element, and a pixel circuit for driving the B light emitting element.

Figure 6:
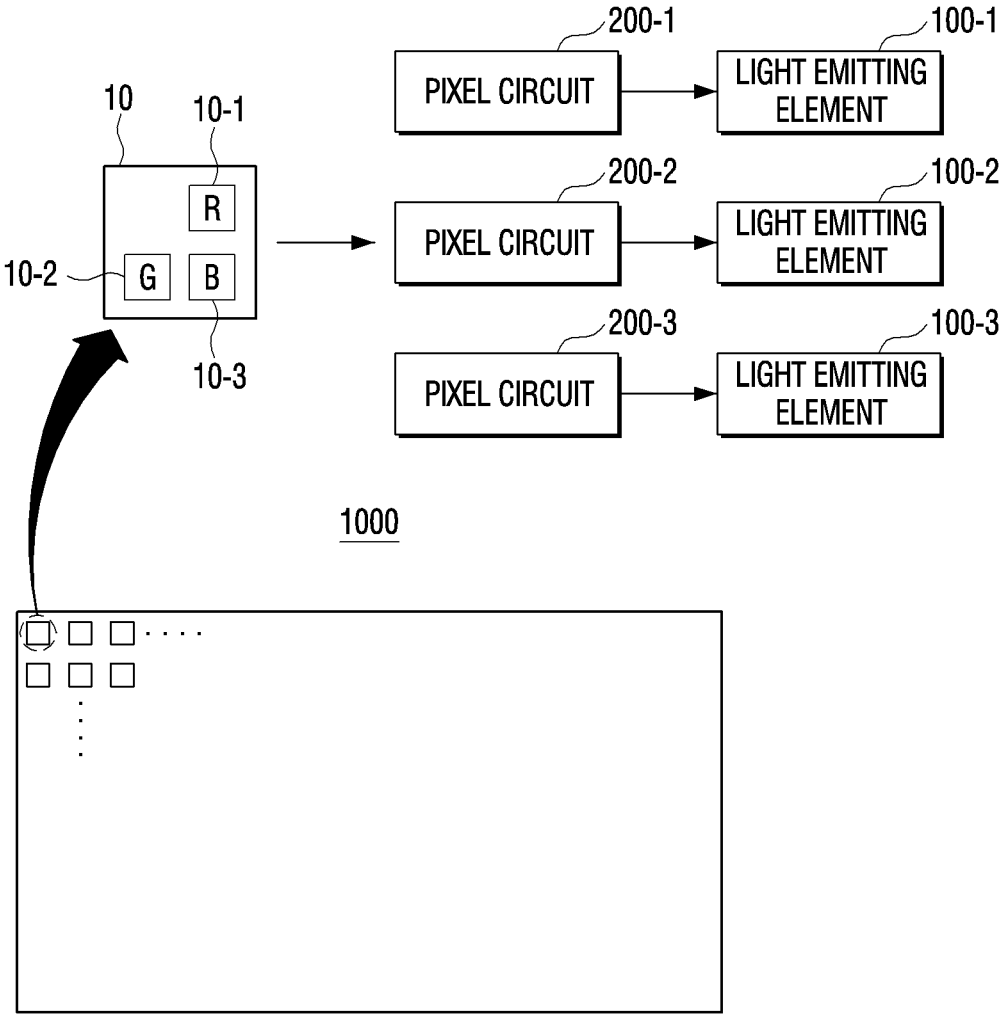
FIG. 6 is a block diagram illustrating a configuration of the display panel according to an embodiment.

As a result, according to an embodiment as illustrated in FIG. 6, the display panel 1000 may include a plurality of pixels, and each pixel 10 may include a plurality of sub-pixels 10-1 to 10-3. Specifically, each pixel 10 may include a plurality of light emitting elements 100-1 to 100-3 and a plurality of pixel circuits 200-1 to 200-3 for driving the plurality of light emitting elements 100-1 to 100-3. In this case, the plurality of light emitting elements 100-1 to 100-3 may include an R light emitting element 100-1, a G light emitting element 100-2, and a B light emitting element 100-3.

In addition, each of the plurality of light emitting elements 100-1 to 100-3 may emit light based on a driving current provided from a pixel circuit for driving each light emitting element among the plurality of pixel circuits 200-1 to 200-3. That is, the light emitting element 100-1 may emit light based on a driving current provided from the pixel circuit 200-1, the light emitting element 100-2 may emit light based on a driving current provided from the pixel circuit 200-2, and the light emitting element 100-3 may emit light based on a driving current provided from the pixel circuit 200-3.

Meanwhile, according to an embodiment, the display panel 1000 may drive the light emitting element in different manners according to the type of the light emitting element. For example, the display panel 1000 may drive a specific type of light emitting element in a PAM manner, and may drive another specific type of light emitting element in a PWM manner. To this end, the display panel 1000 may include a pixel circuit capable of driving the light emitting element in the PAM manner and a pixel circuit capable of driving the light emitting element in the PWM manner.

Specifically, the plurality of pixel circuits 200-1 to 200-3 may include a first pixel circuit for PWM driving a first light emitting element among the plurality of light emitting elements 100-1 to 100-3, and a second pixel circuit for PAM driving a second light emitting element among the plurality of light emitting elements 100-1 to 100-3. In this case, a size of the first pixel circuit may be larger than the size of the second pixel circuit.

In addition, the first light emitting element may include the G emitting element, and the second emitting light element may include the R light emitting element or the B light emitting element.

Specifically, the first pixel circuit may provide a first driving current having amplitude corresponding to a PAM data voltage applied to the first pixel circuit to the first light emitting element for a time corresponding to a PWM data voltage applied to the first pixel circuit. In this case, the gray scale of light emitted from the first light emitting element may be controlled by a time when the first driving current is provided to the first light emitting element according to the magnitude of the PWM data voltage.

In addition, the second pixel circuit may provide a second driving current having amplitude corresponding to a PAM data voltage applied to the second pixel circuit to the second light emitting element. In this case, the gray scale of light emitted from the second light emitting element may be controlled by the amplitude of the second driving current according to the magnitude of the PAM data voltage.

That is, the first pixel circuit may drive the G light emitting element among the light emitting elements included in the display panel 1000 using a PWM driving manner. In this case, for each G light emitting element, the first pixel circuit for driving the G light emitting element may be included in the display panel 1000.

In addition, the second pixel circuit may drive the R light emitting element and the B light emitting element among the light emitting elements included in the display panel 1000 using a PAM driving manner. In this case, for each R light emitting element, the second pixel circuit for driving the R light emitting element may be included in the display panel 1000, and for each B light emitting element, the second pixel circuit for driving the B light emitting element may be included in the display panel 1000.

The pixel circuit as described above will be described in more detail hereinbelow.

Figure 7:
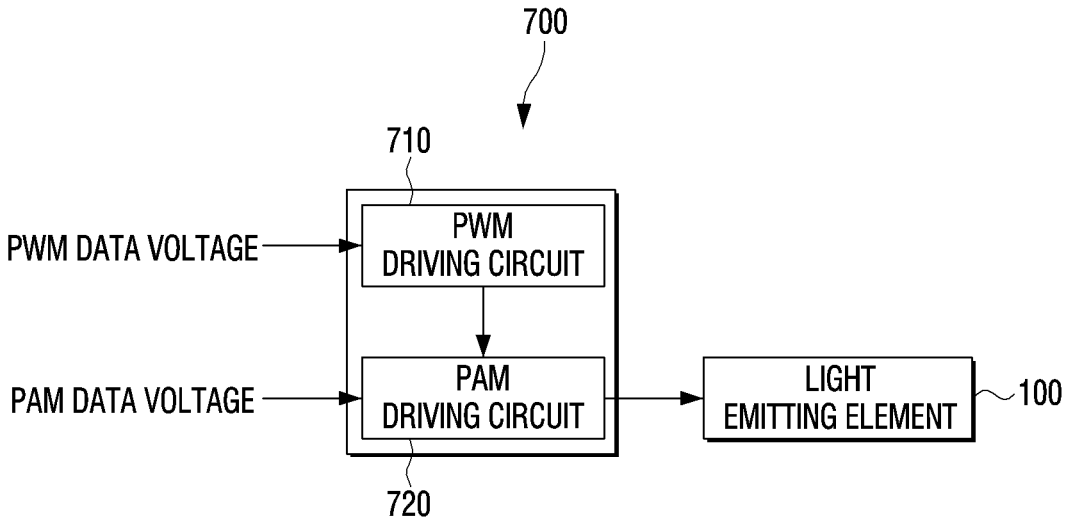
FIG. 7 is a block diagram illustrating a configuration of a pixel circuit according to an embodiment.
Figure 8:
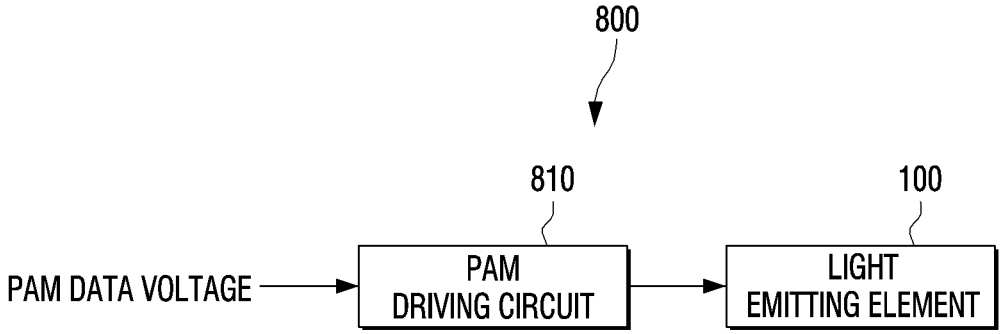
FIG. 8 is a block diagram illustrating a configuration of a pixel circuit according to an embodiment.

FIGS. 7 and 8 are diagrams for describing pixel circuits 700 and 800 according to an embodiment.

First, as illustrated in FIG. 7, a first pixel circuit 700 may provide a driving current to the light emitting element 100. Here, the light emitting element 100 may include the G light emitting element.

In this case, the first pixel circuit 700 may control the amplitude and pulse width of the driving current for driving the light emitting element 100 together by receiving a PAM data voltage and a PWM data voltage from a data driver, for example, and may drive the light emitting element 100 by providing the light emitting element 100 with the driving current controlled in both the amplitude and pulse width.

To this end, as illustrated in FIG. 7, the first pixel circuit 700 may include a PWM driving circuit 710 and a PAM driving circuit 720.

Here, the controlling of the amplitude and pulse width of the driving current "together" does not require that the first pixel circuit 700 simultaneously controls the amplitude and pulse width of the driving current at the same time, but indicates that PWM driving and PAM driving are used together for a gray scale representation.

That is, the PAM driving circuit 720 may control the amplitude of the driving current provided to the light emitting element 100 based on the PAM data voltage. In addition, the PWM driving circuit 710 may control the pulse width of the driving current provided to the light emitting element 100 based on the PWM data voltage.

Specifically, the PAM driving circuit 720 provides a driving current having amplitude corresponding to the PAM data voltage to the light emitting element 100. In this case, the PWM driving circuit 710 controls the pulse width of the driving current by controlling a driving time of the driving current (i.e., the driving current having the amplitude corresponding to the PAM data voltage) provided by the PAM driving circuit 720 to the light emitting element 100 based on the PWM data voltage.

In this case, according to an embodiment, the PAM data voltage may be collectively applied to all pixels (or all sub-pixels) included in the display panel 1000, and the PAM data voltage applied collectively may be a voltage of the same magnitude.

The first pixel circuit 700 controls the gray scale of the light emitted from the light emitting element 100 by the PWM driving manner. That is, the PWM driving manner is a manner of expressing the gray scale according to a light emitting time of the light emitting element 100. Therefore, when the light emitting element 100 is driven by the PWM driving manner, various gray scales may be expressed by varying the light emitting time even when the amplitude of the driving current is the same.

Specifically, a data driver may provide the PWM data voltage to the first pixel circuit 700 to express the gray scale through PWM driving, and the first pixel circuit 700 may control the gray scale of the light emitted from the light emitting element 100 by controlling the driving time of the driving current according to the PWM data voltage.

In this case, the first pixel circuit 700 may also be referred to as a PWM pixel circuit in that it represents the gray scale of the light emitting element 100 through the PWM driving manner.

Figure 1:
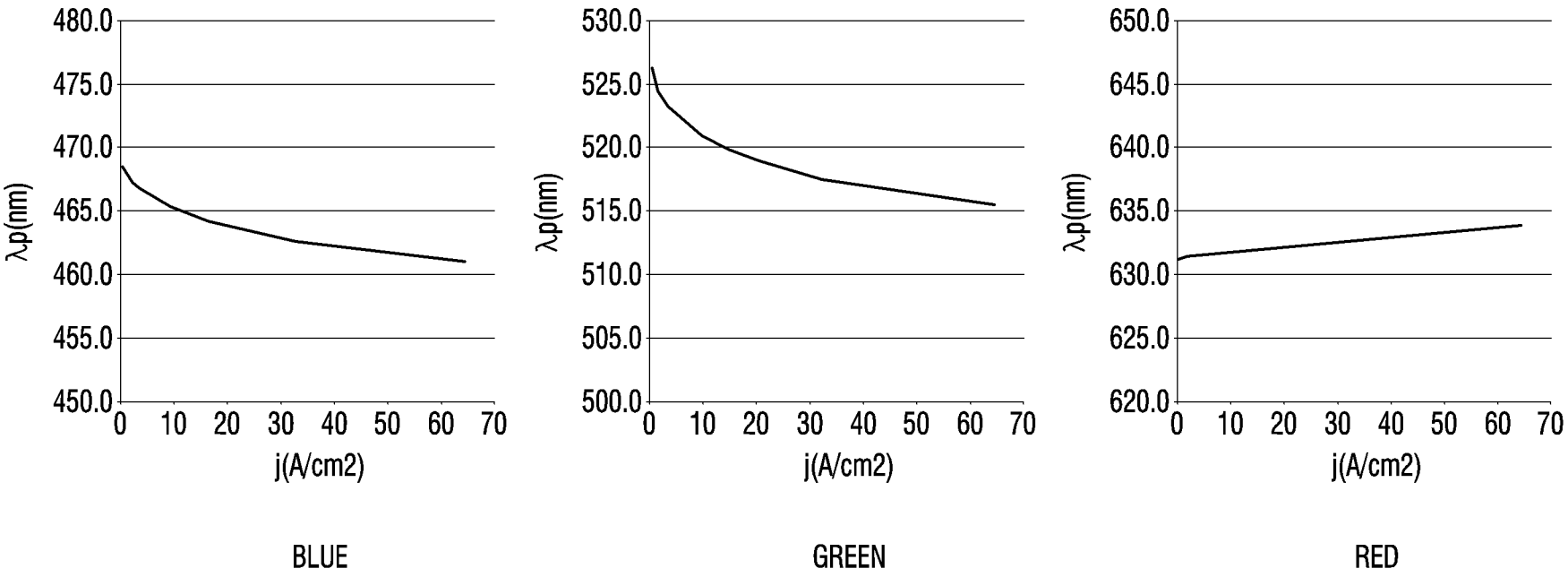
FIG. 1 is a graph illustrating a change in wavelength according to the magnitude of a driving current flowing through a blue LED, a green LED, and a red LED.

As such, according to an embodiment, the first pixel circuit 700 drives the light emitting element 100 through the PWM driving manner. Accordingly, as described above with reference to FIG. 1, a problem in which the LED is driven by the PAM driving manner and the wavelength of the light emitted from the LED (in particular, the micro LED) is changed according to the gray scale may be resolved, thereby reducing color reproducibility.

The first pixel circuit 700 may, however, have a larger size in that it includes the PWM driving circuit 710 and the PAM driving circuit 720.

Accordingly, when the first pixel circuit 700 is used to drive each of the light emitting elements included in all the pixels of the display panel 1000, pixel per inch (PPI) is lowered, which is not suitable for high resolution (e.g., 8K).

Therefore, according to an embodiment, the G light emitting element having a relatively large wavelength change (or wavelength shift) according to the driving current is PWM driven through the first pixel circuit 700, and the R light emitting element and the B light emitting element having relatively small wavelength changes are PAM driven as described below.

As illustrated in FIG. 8, a second pixel circuit 800 may provide a driving current to the light emitting element 100. Here, the light emitting element 100 may include the R light emitting element and the B light emitting element.

In this case, the second pixel circuit 800 may control the amplitude of the driving current for driving the light emitting element 100 by receiving a PAM data voltage from a data driver, for example, and may drive the light emitting element 100 by providing the driving current having the controlled amplitude to the light emitting element 100.

To this end, as illustrated in FIG. 8, the second pixel circuit 800 may include a PAM driving circuit 810.

That is, the PAM driving circuit 810 may control the amplitude of the driving current provided to the light emitting element 100 based on the PAM data voltage. Specifically, the PAM driving circuit 810 may provide a driving current having amplitude corresponding to the PAM data voltage to the light emitting element 100.

That is, the data driver may provide the PAM data voltage to the second pixel circuit 800 to express the gray scale through PAM driving, and the second pixel circuit 800 may control the gray scale of the light emitted from the light emitting element 100 by controlling the amplitude of the driving current according to the PAM data voltage.

In this case, the second pixel circuit 800 may also be referred to as a PAM pixel circuit in that it represents the gray scale of the light emitting element 100 through the PAM driving manner.

According to an embodiment, the G light emitting element included in the display panel 1000 is driven through the PWM pixel circuit, and the R and B light emitting elements included in the display panel 1000 are driven through the PAM pixel circuit. Accordingly, the display panel 1000 of high resolution may be provided in that an entire area occupied by the pixel circuits is smaller than the case in which all the light emitting circuits are driven through the PWM pixel circuit, while solving the problem reduced color reproducibility as the wavelength of the light is changed according to the gray scale.

Figure 9:
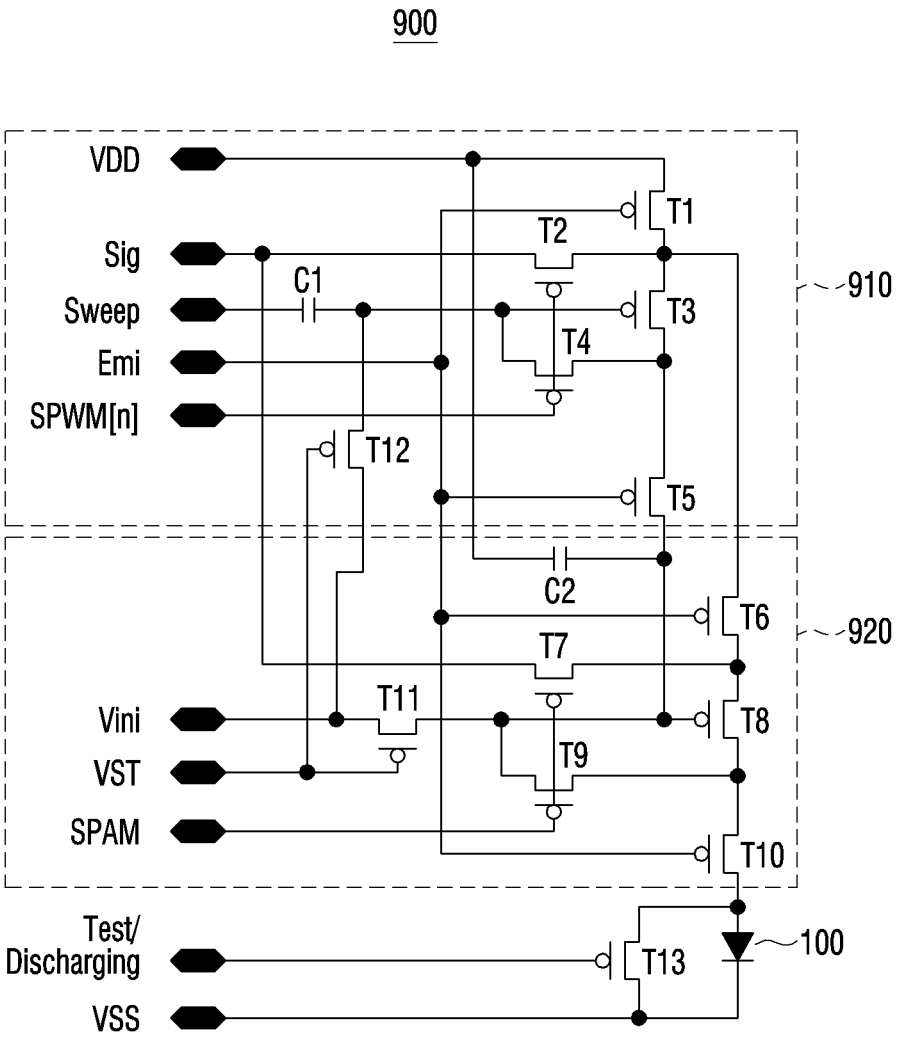
FIGS. 9 to 11 are circuit diagrams of pixel circuits according to an embodiment.
Figure 10:
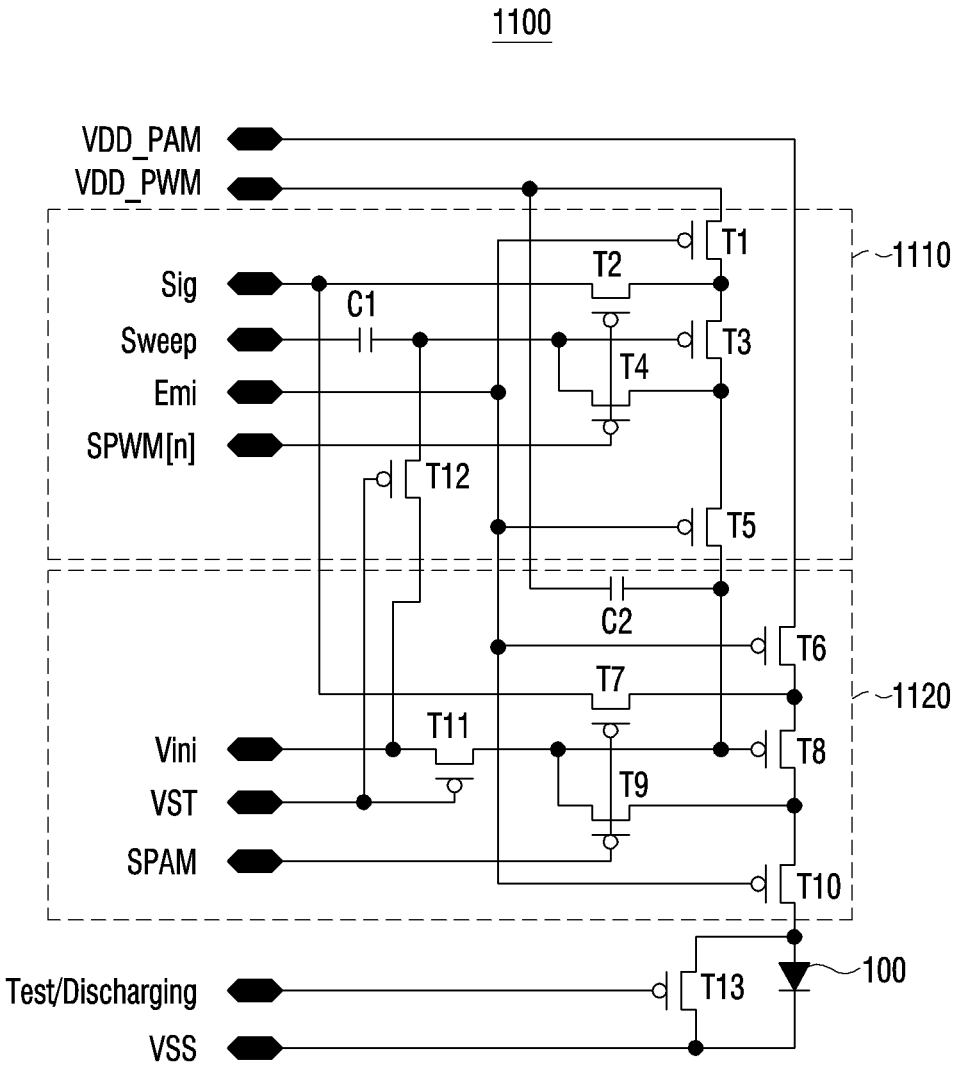
Figure 11:
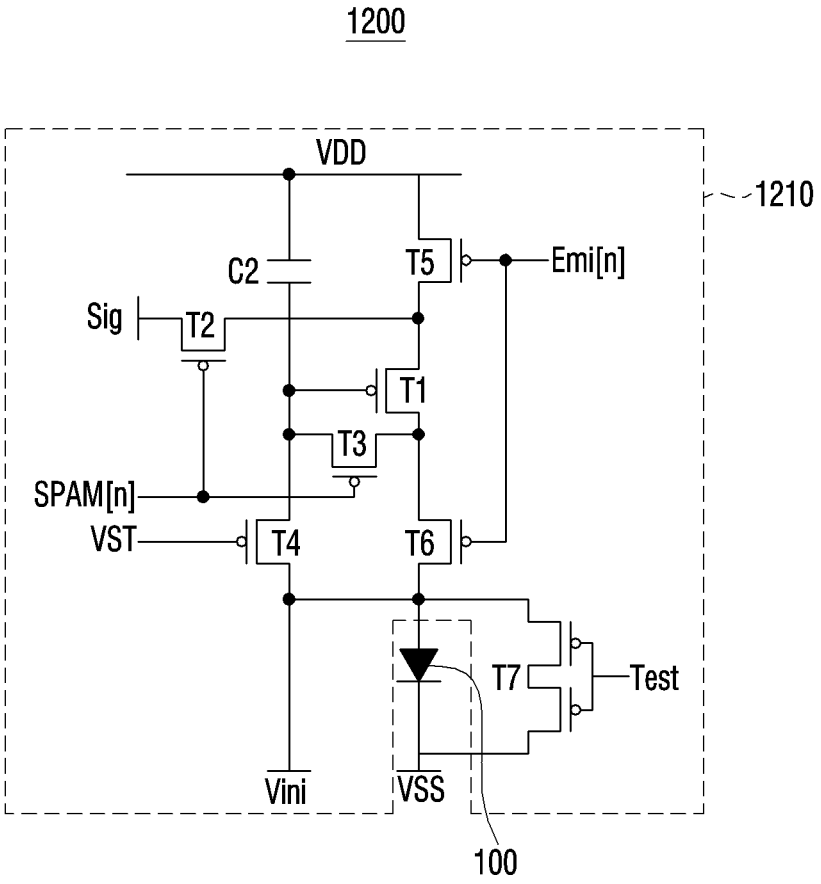

FIGS. 9 to 11 illustrate circuit diagrams of pixel circuits according to an embodiment.

First, FIGS. 9 and 10 illustrate an example of a first pixel circuit, that is, PWM pixel circuits 900 and 1100. The PWM pixel circuits 900 and 1100 may include PWM driving circuits 910 and 1110 and PAM driving circuits 920 and 1120, and may provide a driving current to the light emitting element 100 through these driving circuits.

Specifically, the PAM driving circuits 920 and 1120 may control the amplitude of the driving current provided to the light emitting element 100 based on an applied PAM data voltage Sig. In addition, the PWM driving circuits 910 and 1110 may control a driving time of the driving current provided by the PAM driving circuits 920 and 1120 to the light emitting element 100 based on an applied PWM data voltage Sig. That is, the PWM driving circuits 910 and 1110 control a pulse width of the driving current based on the applied PWM data voltage Sig.

In this case, the PAM data voltage and the PWM data voltage may be applied to the PAM driving circuit and the PWM driving circuit, respectively, by time division.

Accordingly, the PWM pixel circuits 900 and 1100 may provide a driving current having a pulse width corresponding to a PWM data voltage for gray scale representation for each pixel to the light emitting element 100, and the light emitting element 100 may emit light according to the driving current provided from the PWM pixel circuits 900 and 1100.

FIG. 11 illustrates an example of a second pixel circuit, that is, a PAM pixel circuit 1200. The PAM pixel circuit 1200 may include a PAM driving circuit 1210, and may provide a driving current to the light emitting element 100 through the PAM driving circuit 1210.

Specifically, the PAM driving circuit 1210 may control the amplitude of the driving current provided to the light emitting element 100 based on an applied PAM data voltage Sig.

Accordingly, the PAM pixel circuit 1200 may provide a driving current having amplitude corresponding to a PAM data voltage for gray scale representation for each pixel to the light emitting element 100, and the light emitting element 100 may emit light according to the driving current provided from the PAM pixel circuit 1200.

Referring to FIGS. 9 and 10, the PWM pixel circuits 900 and 1100 may be implemented with thirteen transistors (i.e., T1 to T13) and two capacitors (i.e., C1 and C2) in that the PWM pixel circuits 900 and 1100 include the PWM driving circuits 910 and 1110 and the PAM driving circuits 920 and 1120. Meanwhile, referring to FIG. 11, the PAM pixel circuit 1200 may be implemented with seven transistors (i.e., T1 to T7) and one capacitor (i.e., C2) in that it includes only the PAM driving circuit 1210. As such, the PAM pixel circuit 1200 may be implemented in a smaller size than the PWM pixel circuits 900 and 1100.

Therefore, the case where the pixel circuit for driving the G light emitting element is formed or implemented by the PWM pixel circuits 900 and 1100, and the pixel circuits for driving the R and B light emitting elements are formed or implemented by the PAM pixel circuit 1200 occupies a smaller area in the display panel 1000, as compared to the case where all the pixel circuits are formed by the PWM pixel circuits 900 and 1100. For example, in the case where all the pixel circuits are formed by the PWM pixel circuits 900 and 1100, the area of the entire pixel circuit is 48000 $\mu m^2$, while in the case where the pixel circuits for driving the R and B light emitting elements are formed by the PAM pixel circuit 1200 and the pixel circuit for driving the G light emitting element is formed by the PWM pixel circuits 900 and 1100 according to an embodiment, the area of the entire pixel circuit is 29000 $\mu m^2$, which may be relatively reduced by 40%.

Accordingly, according to an embodiment, it is possible to provide a high resolution display panel 1000 while solving a problem in which the wavelength is changed according to the gray scale, thereby reducing color reproducibility.

It is understood that the circuits illustrated in FIGS. 9 to 11 are merely examples, and one or more other embodiments are not limited thereto. That is, the PWM pixel circuit may be implemented in various types of circuits and circuit arrangements including the PWM driving circuit and the PAM driving circuit. In addition, the PAM pixel circuit may be implemented in various types of circuits and circuit arrangements including the PAM driving circuit.

In the example described above, it has been described that the pixel includes the three kinds of sub-pixels, that is, the R, G, and B sub-pixels, and in this case, the pixel circuit for driving the G light emitting element is implemented with the PWM pixel circuit, and the pixel circuits for driving the R light emitting element and the B light emitting element are each implemented with the PAM pixel circuit. It is understood that one or more other embodiments are not limited thereto.

For example, according to one or more other embodiments, even in a case in which the pixel includes four kinds of sub-pixels, for example, R, G, B, and W sub-pixels, the pixel circuit for driving the G light emitting element may be implemented with the PWM pixel circuit, and the pixel circuits for driving the R light emitting element and the B light emitting element may each be implemented with the PAM pixel circuit. In this case, a pixel circuit for driving a W light emitting element may be implemented with the PWM pixel circuit.

In accordance with another aspect of the disclosure, a plurality of pixel circuits respectively corresponding to a plurality of light-emitting elements constituting a pixel, includes a first pixel circuit configured to pulse width modulation (PWM)-drive a first light emitting element among the plurality of light emitting elements and a second pixel circuit configured to pulse amplitude modulation (PAM)-drive a second light emitting element among the plurality of light emitting elements.

The first pixel circuit may PWM-drive a green light emitting element and the second pixel circuit may PAM-drive a red light emitting element and a blue light emitting element. A size of the first pixel circuit may be greater than a size of the second pixel circuit.

The first pixel circuit may provide, to the first light emitting element for a time corresponding to a PWM data voltage applied to the first pixel circuit, a first driving current having an amplitude corresponding to a first PAM data voltage applied to the first pixel circuit and the second pixel circuit may provide, to the second light emitting element, a second driving current having an amplitude corresponding to a second PAM data voltage applied to the second pixel circuit.

Each of the plurality of light emitting elements may be a micro light emitting diode (LED).

The first pixel circuit may change a voltage of a terminal of the first pixel circuit according to a sweep voltage applied to the first pixel circuit to provide, to the first light emitting element, a driving current having a pulse width corresponding to a PWM data voltage and the sweep voltage may be a voltage that is linearly changed from a second voltage after changing from a first voltage to the second voltage.

Meanwhile, the first pixel circuit (i.e., the PWM pixel circuit) according to an embodiment may change a voltage of a terminal of the first pixel circuit according to a sweep voltage applied to the first pixel circuit to provide a driving current having a pulse width corresponding to the PWM data voltage to the first light emitting element.

Here, the first pixel circuit may include a transistor, and the terminal of the first pixel circuit may be a gate terminal of the transistor. In this case, the first pixel circuit may control the pulse width of the driving current by performing a switching operation of the transistor based on the voltage of the gate terminal of the transistor that changes according to the sweep voltage.

The sweep voltage is a voltage applied externally to change the voltage of the gate terminal of the transistor. Further, the sweep voltage may be a voltage that is stepped up from a first voltage to a second voltage before an emission time of the first light emitting element, and then decreases with time from the second voltage during the emission time. In this case, the sweep voltage may decrease from the second voltage to the first voltage during the emission time.

Therefore, the voltage of the gate terminal of the transistor may increase by a difference between the second voltage and the first voltage as the sweep voltage increases, and may decrease from the increased voltage as the sweep voltage decreases.

In this case, the pulse width of the driving current may be determined based on the time until the decreased voltage of the gate terminal becomes a specific voltage. Here, the specific voltage may be a voltage determined based on the driving voltage for driving the first pixel circuit.

Specifically, when the PWM data voltage is applied, the first pixel circuit may apply a voltage based on the PWM data voltage to the gate terminal of the transistor. Then, if a step-up sweep voltage is applied to the first pixel circuit before the light emitting time starts, the voltage of the gate terminal of the transistor may increase by a step-up voltage value due to a coupling effect.

Figure 12:
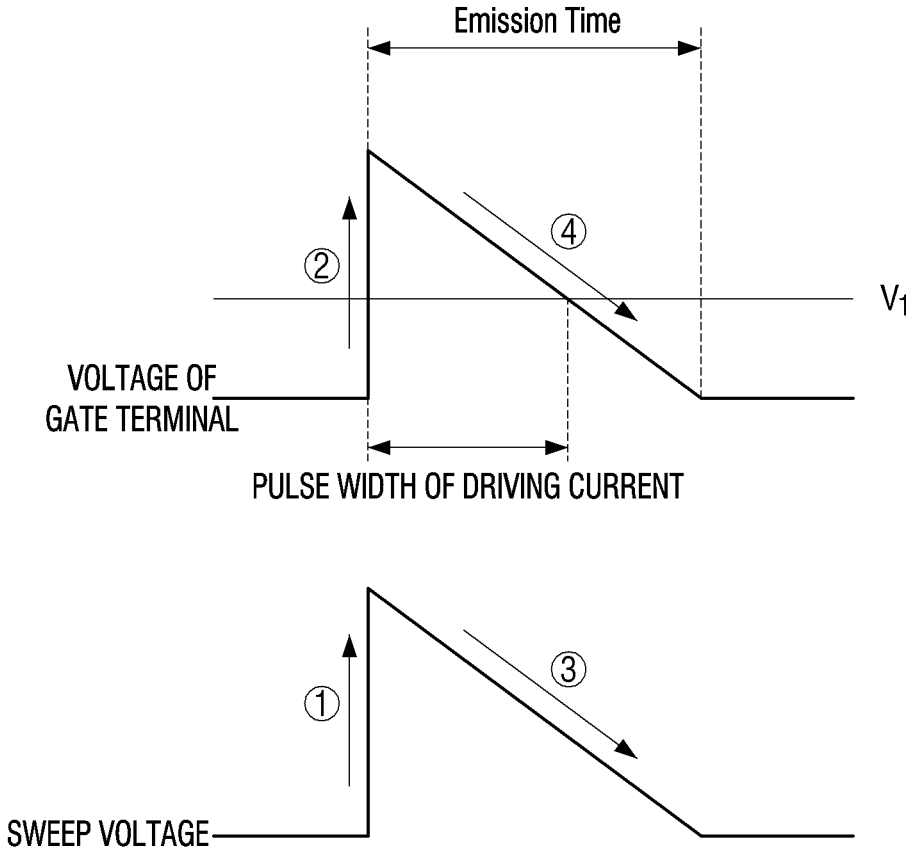
FIG. 12 is a diagram for describing a method for determining a pulse width of a driving current according to an embodiment.

For example, referring to FIG. 12, if the sweep voltage is stepped up as ①, the voltage applied to the gate terminal of the transistor is stepped up according to the sweep voltage as ②.

If the emission time starts, the first pixel circuit may provide the driving current to the first light emitting element according to the voltage of the gate terminal of the transistor. For example, as illustrated in FIG. 12, when the voltage of the gate terminal increased according to the sweep voltage is greater than the specific voltage $V_1$, the first pixel circuit may provide the driving current to the first light emitting element by using the transistor in an off state.

On the other hand, if the emission time starts, the sweep voltage that gradually decreases with time may be applied to the first pixel circuit. Even in this case, the voltage of the gate terminal of the transistor changes according to the sweep voltage. That is, if the decreased sweep voltage is applied, the voltage of the gate terminal of the transistor gradually decreases according to the sweep voltage.

For example, referring to FIG. 12, if the sweep voltage decreases in the form of a triangle waveform as ③, the increased voltage of the gate terminal decreases in the form of a triangle waveform according to the sweep voltage as ④.

In this case, if the decreased voltage of the gate terminal of the transistor reaches the specific voltage $V_1$, the first pixel circuit may perform a switching operation of the transistor. For example, the first pixel circuit may turn on the transistor in the off state. As such, if the switching operation of the transistor is performed, the first pixel circuit may stop a supply of the driving current to the first light emitting element.

Accordingly, as illustrated in FIG. 12, the pulse width of the driving current may be determined.

Meanwhile, the difference between the first voltage and the second voltage may correspond to a range of the PWM data voltage for expressing the gray scale of the light emitted from the first light emitting element, and is described in detail below with a driving method of the first pixel circuit.

Figure 13:
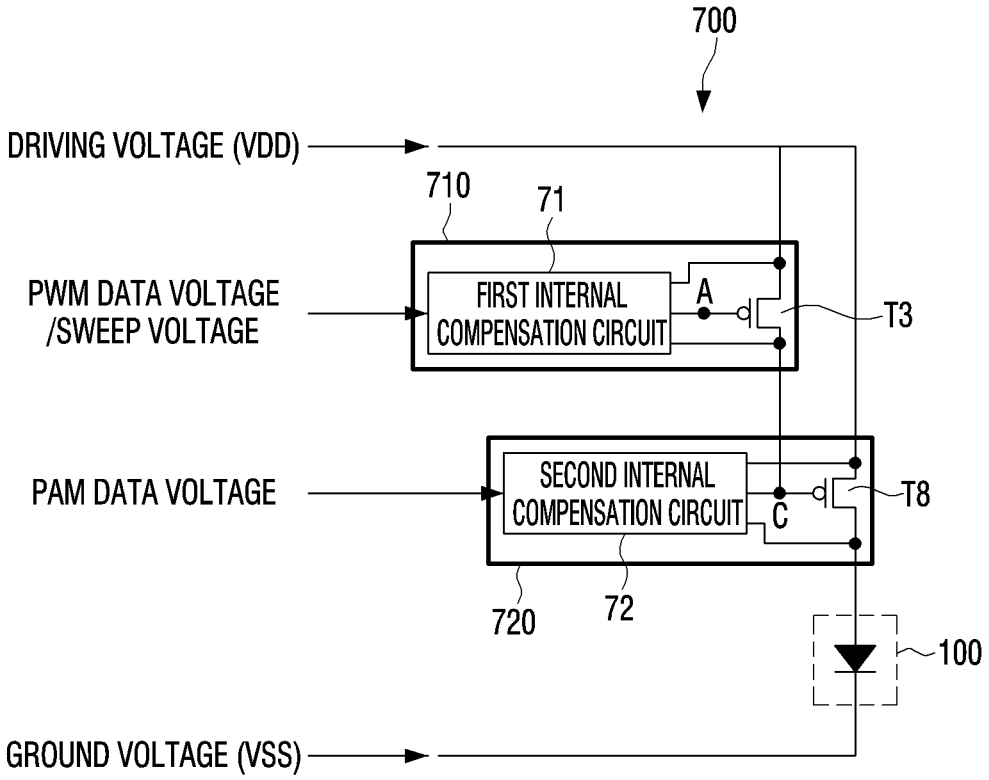
FIG. 13 is a block diagram illustrating a configuration of a pixel circuit according to an embodiment.

FIG. 13 illustrates a block diagram of a first pixel circuit 700 according to an embodiment.

A first pixel circuit 700 includes a PAM driving circuit 720 and a PWM driving circuit 710. The PAM driving circuit 720 and the PWM driving circuit 710 include transistors and internal compensation circuits for compensating threshold voltages of the transistors, respectively.

For example, as illustrated in FIG. 13, the PAM driving circuit 720 may include a transistor T8 and a second internal compensation circuit 72.

The transistor T8 may provide a driving current having different amplitudes to the light emitting element 100 according to the magnitude of a voltage applied to a gate terminal C. Specifically, the PAM driving circuit 720 may provide a driving current having an amplitude corresponding to the applied PAM data voltage to the light emitting element 100 through the transistor T8.

At this time, the threshold voltage of the transistor T8 may be a problem. Specifically, the display panel 1000 has a plurality of sub-pixels, and each sub-pixel has the transistor T8. Theoretically, transistors manufactured under the same conditions should have the same threshold voltage, but actual transistors may have different threshold voltages even when manufactured under the same conditions, and the transistors T8 included in the display panel 1000 are the same.

As such, when there is a difference between the threshold voltages of the transistors T8 corresponding to each sub-pixel, the transistors T8 provide driving currents having different amplitudes to each light emitting element 100 by the difference of the threshold voltages even when the same PAM data voltage is applied to the gate terminal, which may appear as a mura of the image.

Therefore, according to an embodiment, a threshold voltage deviation between the transistors T8 included in the display panel 1000 is compensated for.

The second internal compensation circuit 72 is a component for compensating for the threshold voltage of the transistor T8. Specifically, when the PAM data voltage is applied, the PAM driving circuit 720 may apply a voltage based on the applied PAM data voltage and the threshold voltage of the transistor T8 to the gate terminal C of the transistor T8 through the second internal compensation circuit 72. Accordingly, the transistor T8 may provide a driving current having an amplitude corresponding to the magnitude of the applied PAM data voltage to the light emitting element 100, regardless of the threshold voltage of the transistor T8.

Therefore, the problem caused by the threshold voltage deviation between the transistors T8 included in the display panel 1000 may be overcome.

As illustrated in FIG. 13, meanwhile, the PWM driving circuit 710 may also include a transistor T3 and a first internal compensation circuit 71.

The transistor T3 may be connected to the gate terminal C of the transistor T8 to control the voltage of the gate terminal of the transistor T8, thereby controlling the pulse width of the driving current. Specifically, if a time corresponding to the PWM data voltage elapses after the light emitting element 100 starts emitting light according to the driving current provided through the transistor T8, the transistor T3 may control the pulse width of the driving current by turning off the transistor T8.

Further, the transistors T3 present in each sub-pixel of the display panel 1000 also have a threshold voltage deviation, and if the threshold voltage deviation is not compensated for, even if the same PWM data voltage is applied to the transistors T3, there is a problem because driving currents having different pulse widths by the threshold voltage deviation are provided to each light emitting element 100.

The first internal compensation circuit 71 is a component for compensating for the threshold voltage of the transistor T3. Specifically, when the PWM data voltage is applied, the PWM driving circuit 710 may apply a voltage based on the applied PWM data voltage and the threshold voltage of the transistor T3 to a gate terminal A of the transistor T3 through the first internal compensation circuit 71. Accordingly, the transistor T3 may provide a driving current having a pulse width corresponding to the magnitude of the applied PWM data voltage to the light emitting element 100, regardless of the threshold voltage of the transistor T3.

Hereinafter, an operation of the internal compensation circuit will be described in more detail with reference to FIG. 14.

Figure 14:
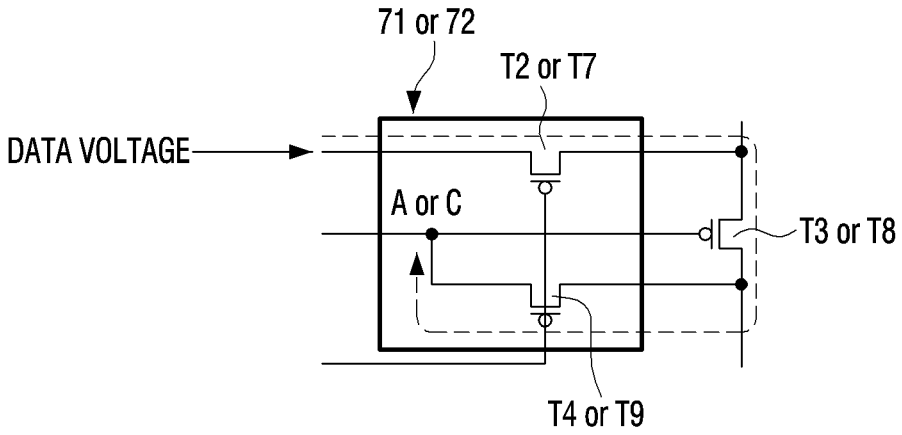
FIG. 14 is a circuit diagram of an internal compensation circuit according to an embodiment.

FIG. 14 is a circuit diagram of an internal compensation circuit 71 or 72 according to an embodiment.

As described above, the PWM driving circuit 710 may include the first internal compensation circuit 71 for compensating for the threshold voltage of the transistor T3.

When the PWM data voltage is applied, the first internal compensation circuit 71 compensates for the threshold voltage of the transistor T3 by applying a voltage corresponding to the sum of the applied PWM data voltage and the threshold voltage of the transistor T3 to the gate terminal C of the transistor T3.

To this end, as illustrated in FIG. 14, the first internal compensation circuit 71 includes a transistor T4 connected between the gate terminal and a drain terminal of the transistor T3, and a transistor T2 having a drain terminal connected to a source terminal of the transistor T3 and a gate terminal connected to a gate terminal of the transistor T4.

Specifically, if (e.g., based on) the transistors T2 and T4 are turned on according to a control signal SPWM[n] applied to the gate terminals of the transistors T2 and T4, the PWM data voltage applied to the source terminal of the transistor T2 is input to the first internal compensation circuit 71.

At this time, when (e.g., based on) the voltage of the gate terminal A of the transistor T3 is in a low state, the transistor T3 is fully turned on. Therefore, the input PWM data voltage is applied to the gate terminal A of the transistor T3 while sequentially passing through the transistor T2, the transistor T3, and the transistor T4. In this case, the voltage of the gate terminal A of the transistor T3 does not increase to the input PWM data voltage, but increases to a voltage corresponding to the sum of the PWM data voltage and the threshold voltage of the transistor T3.

The reason is that when the PWM data voltage is first applied to the first internal compensation circuit 71, because the voltage of the gate terminal A of the transistor T3 is in the low state and the transistor T3 is thus fully turned on, the current flows sufficiently to smoothly increase the voltage of the gate terminal A of the transistor T3. However, as the voltage of the gate terminal A of the transistor T3 increases, the voltage difference between the gate terminal and the source terminal of the transistor T3 decreases, thereby reducing the flow of current. As result, if the voltage difference between the gate terminal and the source terminal of the transistor T3 reaches the threshold voltage of the transistor T3, the transistor T3 is turned off to stop the flow of current.

That is, because the PWM data voltage is applied to the source terminal of the transistor T3, the voltage of the gate terminal A of the transistor T3 increases to the voltage obtained by adding the PWM data voltage to the threshold voltage of the transistor T3. As such, the threshold voltage of the transistor T3 may be compensated by the first internal compensation circuit 71.

Meanwhile, the configuration and operation of the second internal compensation circuit 72 are similar to the first internal compensation circuit 71.

That is, as illustrated in FIG. 14, the second internal compensation circuit 72 includes a transistor T9 connected between a gate terminal and a drain terminal of the transistor T8, and a transistor T7 having a drain terminal connected to a source terminal of the transistor T8 and a gate terminal connected to a gate terminal of a transistor T9.

In addition, the second internal compensation circuit 72 also operates in the same or similar manner as the first internal compensation circuit 71, such that a voltage corresponding to the sum of the PAM data voltage and the threshold voltage of the transistor T8 may be applied to the gate terminal C of the transistor T8.

According to an embodiment as described above, the PWM driving circuit 710 automatically performs internal compensation for the threshold voltage of the transistor T3 internally while setting (or applying) the applied PWM data voltage to the gate terminal A of the transistor T3, which is the same with or similar to the PAM driving circuit 720.

The term "internal compensation" indicates that the threshold voltage of the transistor is self-compensated inside the driving circuit during operation of the driving circuit. Such an internal compensation manner is distinguished from an external compensation manner that compensates for the threshold voltage of the transistor by correcting a data voltage itself to be applied to the driving circuit outside the driving circuit.

As described above, because the threshold voltages of the transistors T3 and T8 are internally compensated, according to an embodiment, when the PAM data voltage is set to the pixels included in the display panel 1000 to display one image frame, the PAM data voltage may be collectively applied to the pixels. Accordingly, it is possible to sufficiently secure a light emitting section in which the light emitting element 100 emits light in an entire time section for displaying one image frame.

Further, according to the embodiment described above, the PWM data voltage is sequentially applied line by line to the pixels included in the display panel 1000 to represent the gray scale for each pixel.

Hereinafter, an operation of the first pixel circuit 700 according to the sweep voltage is described in more detail.

Specifically, when the PWM data voltage is applied, a first driving circuit 710 may apply a voltage based on the PWM data voltage and the threshold voltage of the transistor T3 to the gate terminal A of the transistor T3. Here, the voltage applied to the gate terminal A may be a voltage by summing (or corresponding to a sum of) the PWM data voltage and the threshold voltage of the transistor T3.

In addition, when the PAM data voltage is applied, the PAM driving circuit 720 may apply a voltage based on the PAM data voltage and the threshold voltage of the transistor T8 to the gate terminal C of the transistor T8. Here, the voltage applied to the gate terminal C may be a voltage by summing (or corresponding to a sum of) the PAM data voltage and the threshold voltage of the transistor T8.

Thereafter, when a sweep voltage that is stepped up is applied to the PWM driving circuit 710, the voltage applied to the gate terminal A of the transistor T3 is stepped up by a voltage value at which the sweep voltage is increased. In this case, the magnitude of the sweep voltage applied to the PWM driving circuit 710 may be maintained at the stepped-up voltage value until a light emission period starts.

Thereafter, if the light emission period starts, the PAM driving circuit 720 provides a driving current having amplitude corresponding to the PAM data voltage to the light emitting element 100 through the transistor T8 in an on state, and the light emitting element 100 starts emitting light.

At this time, the sweep voltage applied to the PWM driving circuit 710 gradually decreases from the step-up voltage value to an initial voltage value. Accordingly, the voltage of the gate terminal A of the transistor T3 gradually decreases according to the sweep voltage.

On the other hand, when (e.g., based on) the voltage of the gate terminal A of the transistor T3 increased according to the sweep voltage is greater than a value obtained by summing a driving voltage VDD applied to the source terminal of the transistor T3 and the threshold voltage of the transistor T3, the transistor T3 is in an off state. Accordingly, the transistor T3 in the off state is kept in the off state, until the voltage of the gate terminal A, which decreases according to the sweep voltage, is the value obtained by summing the voltage of the source terminal and the threshold voltage of the transistor T3 (that is, the driving voltage VDD+the threshold voltage of the transistor T3) (for reference, in the case of PMOSFET, the threshold voltage may have a negative value).

Thereafter, if the voltage of the gate terminal A of the transistor T3 reaches the value obtained by summing the driving voltage VDD and the threshold voltage of the transistor T3, the transistor T3 is turned on and, accordingly, the driving voltage VDD applied to the source terminal of the transistor T3 is applied to the gate terminal C of the transistor T8 through the drain terminal.

On the other hand, because the driving voltage VDD is applied to the source terminal of the transistor T8, if (e.g., based on) the driving voltage VDD is applied to the gate terminal C of the transistor T8, the voltage of the gate terminal C of the transistor T8 exceeds the value obtained by summing the voltage of the source terminal and the threshold voltage of the transistor T8 (that is, the driving voltage VDD+the threshold voltage of the transistor T8), such that the transistor T8 that was in the on state may be turned off (for reference, in the case of PMOSFET, the threshold voltage may have a negative value). Accordingly, if the transistor T8 is turned off, the driving current no longer flows, and the light emitting element 100 stops emitting light.

As such, the first pixel circuit 700 may control the pulse width of the driving current by controlling the voltage of the gate terminal A of the transistor according to the sweep voltage.

Meanwhile, FIG. 13 described above illustrates that the driving voltage VDD is applied to the PWM driving circuit 710 and the PAM driving circuit 720 through one line, but this is merely an example and it is understood that one or more other embodiments are not limited thereto. For example, according to another embodiment, the driving voltage VDD may be applied to the PWM driving circuit 710 and the PAM driving circuit 720 through a separate line. That is, a PWM driving voltage VDD_PWM may be applied to the PWM driving circuit 710 through one line, and a PAM driving voltage VDD_PAM may be applied to the PAM driving circuit 720 through another line.

According to an embodiment, by controlling the pulse width of the driving current using the sweep voltage as described above, it is possible to secure a range of the PWM data voltage capable of stably expressing the gray scale.

Specifically, when the PWM data voltage is applied, a voltage having the value obtained by summing the PWM data voltage and the threshold voltage of the transistor T3 is applied to the gate terminal A of the transistor T3. In addition, when the sweep voltage is applied, the voltage of the gate terminal A increases according to the step-up of the sweep voltage, and then the increased voltage of the gate terminal A decreases gradually as the sweep voltage decreases.

In this case, the driving current may be provided to the light emitting element 100 during a time section in which the voltage of the gate terminal A of the transistor T3 changed according to the sweep voltage is greater than a value obtained by summing the source terminal of the transistor T3 (i.e., the driving voltage VDD) and the threshold voltage of the transistor T3.

Accordingly, a PWM data voltage at which the voltage of the gate terminal A of the transistor T3 at the time of step-up becomes the value obtained by summing the driving voltage VDD and the threshold voltage of the transistor T3 may be set to a PWM data voltage for expressing a minimum gray scale (e.g., black). Further, a PWM data voltage at which the voltage of the gate terminal A of the transistor T3 before step-up becomes the value obtained by summing the driving voltage VDD and the threshold voltage of the transistor T3 may be set to a PWM data voltage for expressing a maximum gray scale (e.g., full gray (i.e., white)).

In this case, a difference between the PWM data voltage for expressing the minimum gray scale and the PWM data voltage for expressing the maximum gray scale, that is, a range of the PWM data voltage, may be a voltage value at which the sweep voltage is stepped up.

Therefore, when the voltage value at which the sweep voltage is stepped up is appropriately set according to a gray scale range to be expressed, inverse gamma does not occur, and each gray scale may be expressed through a stable PWM data voltage.

For example, it is assumed that the driving voltage VDD or VDD_PAM is 12.4 V and the maximum voltage value of the PWM data voltage provided by a data driver is 15 V.

Figure 15:
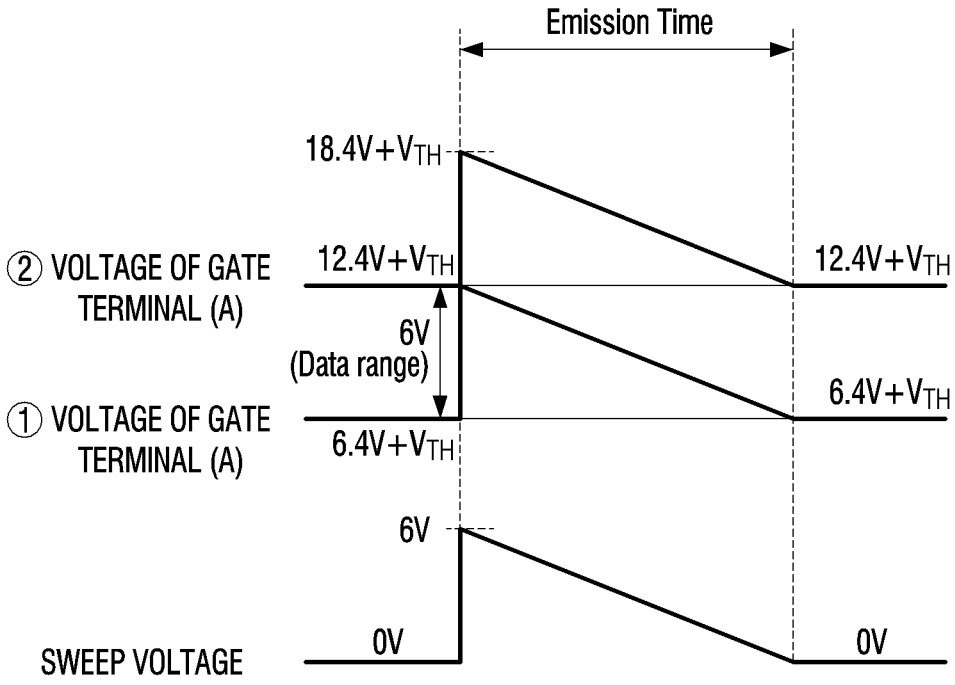
FIG. 15 is a diagram for describing a range of a sweep voltage and a PWM data voltage according to an embodiment.

Meanwhile, from the fact that the range of PWM data voltage may be 6 V or more in order to express gray scale of 1024, according to an embodiment, as illustrated in FIG. 15, the voltage value at which the sweep voltage is stepped up may be set to 6 V. For example, the sweep voltage may have a voltage waveform stepping up from initial voltage of 0 V to 6 V and thereafter gradually decreasing from 6 V to 0 V.

Accordingly, the range of the PWM data voltage may be 6 V, the PWM data voltage for minimum gray scale (i.e., black) may be 6.4 V, and the PWM data voltage for maximum gray scale (i.e., full gray) may be 12.4 V.

Meanwhile, ① of FIG. 15 illustrates a voltage waveform of the gate terminal A of the transistor T3 according to the sweep voltage when the PWM data voltage of 6.4 V is applied to the first pixel circuit.

Specifically, referring to ① of FIG. 15, the voltage of the gate terminal A increases by 6 V from 6.4 V+$V_{TH}$ to 12.4 V+$V_{TH}$, and then gradually decreases to 6.4 V+$V_{TH}$.

In this case, because the voltage of the gate terminal A does not exceed the voltage value (12.4 V+$V_{TH}$) obtained by summing the voltage of the source terminal of the transistor T3 (i.e., because the driving voltage is applied to the source terminal, the voltage of the source terminal is 12.4 V) and the threshold voltage $V_{TH}$ of the transistor T3, the driving current is not provided to the light emitting element 100, and therefore, the light emitting element 100 does not emit light.

Meanwhile, ② of FIG. 15 illustrates a voltage waveform of the gate terminal A of the transistor T3 according to the sweep voltage when the PWM data voltage of 12.4 V is applied to the first pixel circuit.

Specifically, referring to ② of FIG. 15, the voltage of the gate terminal A increases by 6 V from 12.4 V+$V_{TH}$ to 18.4 V+$V_{TH}$, and then gradually decreases to 12.4 V+$V_{TH}$.

In this case, during the entire emission time, the voltage of the gate terminal A is greater than the voltage value obtained by summing the voltage of the source terminal of the transistor T3 and the threshold voltage $V_{TH}$ of the transistor T3 (that is, 12.4 V+$V_{TH}$). Accordingly, during the entire emission time, the driving current is provided to the light emitting element 100, and the light emitting element 100 may express the maximum gray scale.

As such, according to an embodiment, it is possible to secure the range of the PWM data voltage that stably expresses the gray scale through the sweep voltage having a specific waveform.

FIG. 15 describes that the sweep voltage is stepped up by 6 V, but this is merely an example and it is understood that one or more other embodiments are not limited thereto. For example, according to another embodiment, the PWM data voltage for expressing the minimum and maximum gray scales may have the range of 6 V or more by setting the sweep voltage to be stepped up by 6 V or more.

Hereinafter, a configuration and an operation of a pixel circuit according to an embodiment are described in more detail with reference to FIGS. 16 to 19.

Figure 16:
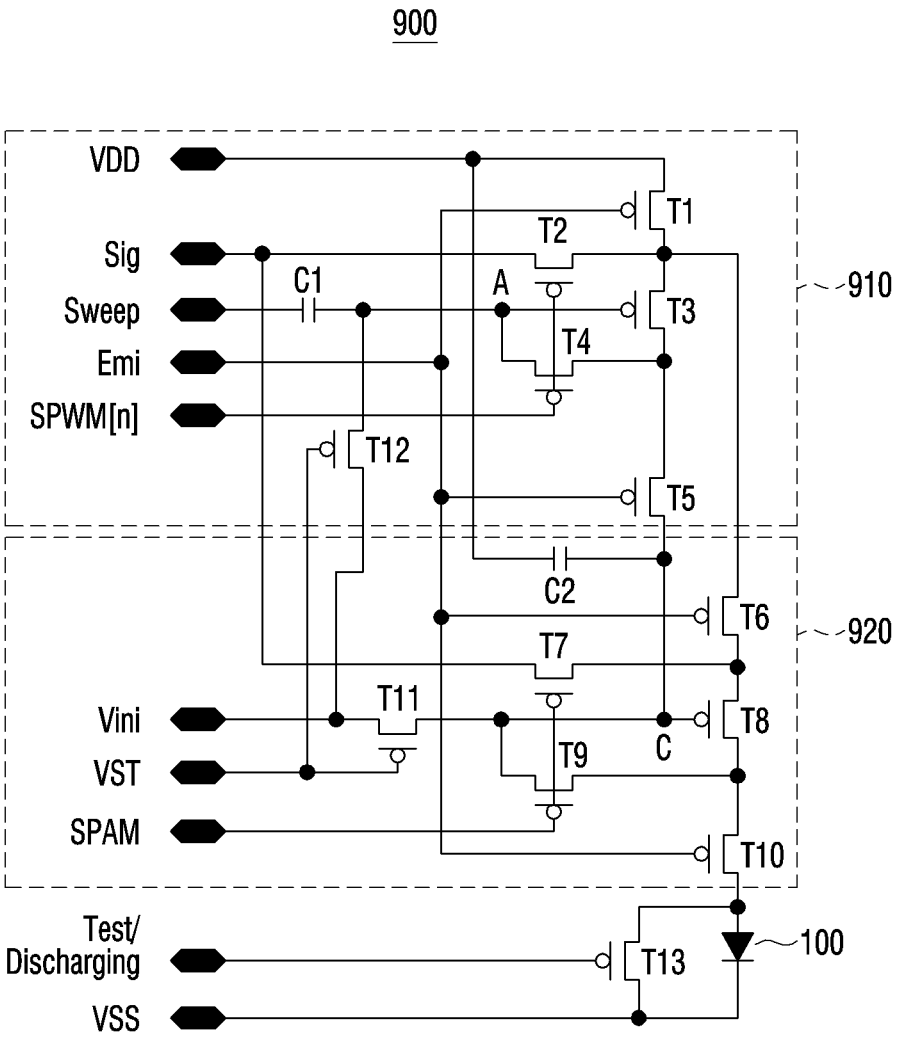
FIG. 16 is a detailed circuit diagram of a pixel circuit according to an embodiment.

FIG. 16 is a detailed circuit diagram of a pixel circuit 900 according to an embodiment. First, the elements constituting a first pixel circuit 900 and a connection relation between the elements are described with reference to FIG. 16. For reference, the pixel circuit 900 illustrated in FIG. 16 is the same as the pixel circuit 900 illustrated in FIG. 9.

FIG. 16 illustrates a circuit associated with one sub-pixel, that is, one light emitting element 100 and a PWM pixel circuit 900 for driving the one light emitting element 100.

Referring to FIG. 16, the PWM pixel circuit 900 may include a PWM driving circuit 910 and a PAM driving circuit 920.

Specifically, the PAM driving circuit 920 includes a first transistor T8, a second transistor T9 connected between a drain terminal and a gate terminal of the first transistor T8, and a third transistor T7 having a drain terminal connected to a source terminal of the first transistor T8 and a gate terminal connected to a gate terminal of the second transistor T9, and receiving a data signal Sig (that is, a PAM data voltage) through a source terminal.

If (e.g., based on) the PAM data voltage is applied through the source terminal of the third transistor T7 while the second transistor T9 and the third transistor T7 are turned on according to a control signal SPAM, the PAM driving circuit 920 applies to the gate terminal of the first transistor T8 by a voltage equal to the sum of the applied PAM data voltage and a threshold voltage of the first transistor T8 through the first transistor T8 and the second transistor T9 that are turned on.

Meanwhile, the PWM driving circuit 910 includes a fourth transistor T3, a fifth transistor T4 connected between a drain terminal and a gate terminal of the fourth transistor T3, and a sixth transistor T2 having a drain terminal connected to a source terminal of the fourth transistor T3 and a gate terminal connected to a gate terminal of the fifth transistor T4, and receiving a data signal Sig (that is, a PWM data voltage) through a source terminal.

If (e.g., based on) the PWM data voltage is applied through the source terminal of the sixth transistor T2 while the fifth transistor T4 and the sixth transistor T2 are turned on according to a control signal SPWM(n), the PWM driving circuit 910 applies to the gate terminal A of the fourth transistor T3 by a voltage equal to the sum of the applied PWM data voltage and a threshold voltage of the fourth transistor T3 through the fourth transistor T3 and the fifth transistor T4 that are turned on.

A seventh transistor T1 has a source terminal connected to a driving voltage terminal (or a driving voltage signal) VDD of the PWM pixel circuit 900, and a drain terminal that is commonly connected to the drain terminal of the sixth transistor T2 and the source terminal of the fourth transistor T3.

The seventh transistor T1 is turned on/off according to a control signal Emi to electrically connect or disconnect the driving voltage terminal VDD and the PWM driving circuit 910.

An eighth transistor T5 has a source terminal connected to the drain terminal of the fourth transistor T3 and a drain terminal connected to the gate terminal of the first transistor T8.

A ninth transistor T6 has a source terminal that is commonly connected to the source terminal of the fourth transistor T3, the drain terminal of the sixth transistor T2, and the drain terminal of the seventh transistor T1, and a drain terminal that is commonly connected to the source terminal of the first transistor T8 and the drain terminal of the third transistor T7.

The eighth transistor T5 and the ninth transistor T6 are turned on/off according to the control signal Emi to electrically connect or disconnect the PWM driving circuit 910 and the PAM driving circuit 920.

A tenth transistor T10 has a source terminal connected to the drain terminal of the first transistor T8, and a drain terminal connected to an anode terminal of the light emitting element 100. The tenth transistor T10 is turned on/off according to the control signal Emi to electrically connect or disconnect the PAM driving circuit 920 and the light emitting element 100.

A first capacitor C1 has one end commonly connected to the gate terminal of the fourth transistor T3 and the drain terminal of the fifth transistor T4, and the other end to which a sweep voltage (i.e., Vsweep) is applied.

An eleventh transistor T11 has a drain terminal commonly connected to the gate terminal of the first transistor T8 and the drain terminal of the second transistor T9, and a source terminal to which an initial voltage Vini is applied.

A twelfth transistor T12 has a source terminal connected to one end of the first capacitor C1 and a drain terminal connected to the source terminal of the eleventh transistor T11.

The second capacitor C2 has one end connected to the driving voltage terminal VDD, and the other end commonly connected to the gate terminal of the first transistor T8, the drain terminal of the second transistor T9, the drain terminal of the eleventh transistor T11, and the drain terminal of the eighth transistor T5.

The eleventh transistor T11 and the twelfth transistor T12 are turned on according to a control signal VST to apply the initial voltage Vini to the gate terminal C of the first transistor T8 and the gate terminal A of the fourth transistor T3.

In order to prevent the driving voltage VDD from being coupled to the gate terminal C of the first transistor T8 through the second capacitor C2 after the voltages of the gate terminals C and A of the first transistor T8 and the fourth transistor T3 are initialized, the eleventh transistor T11 and the twelfth transistor T12 remain in the on state according to the control signal VST for a predetermined time even after the driving voltage VDD is applied to one end of the second capacitor C2 to apply the initial voltage Vini to the gate terminals C and A of the first transistor T8 and the fourth transistor T3.

A thirteenth transistor T13 is connected between the anode terminal and a cathode terminal of the light emitting element 100.

Before the light emitting element 100 is mounted on the driving circuit layer 40 (i.e., TFT layer) and electrically connected to the PWM pixel circuit 900, the thirteenth transistor T13 may be turned on according to a control signal Test to check whether the PWM pixel circuit 900 is abnormal. In addition, after the light emitting element 100 is mounted on the TFT layer and electrically connected to the PWM pixel circuit 900, the thirteenth transistor T13 may be turned on according to a control signal Discharging to discharge the charge remaining in the light emitting element 100.

The cathode terminal of the light emitting element 100 is connected to a ground voltage VSS terminal.

Hereinafter, an operation of the PWM pixel circuit 900 is described in more detail with reference to FIG. 17.

Figure 17:
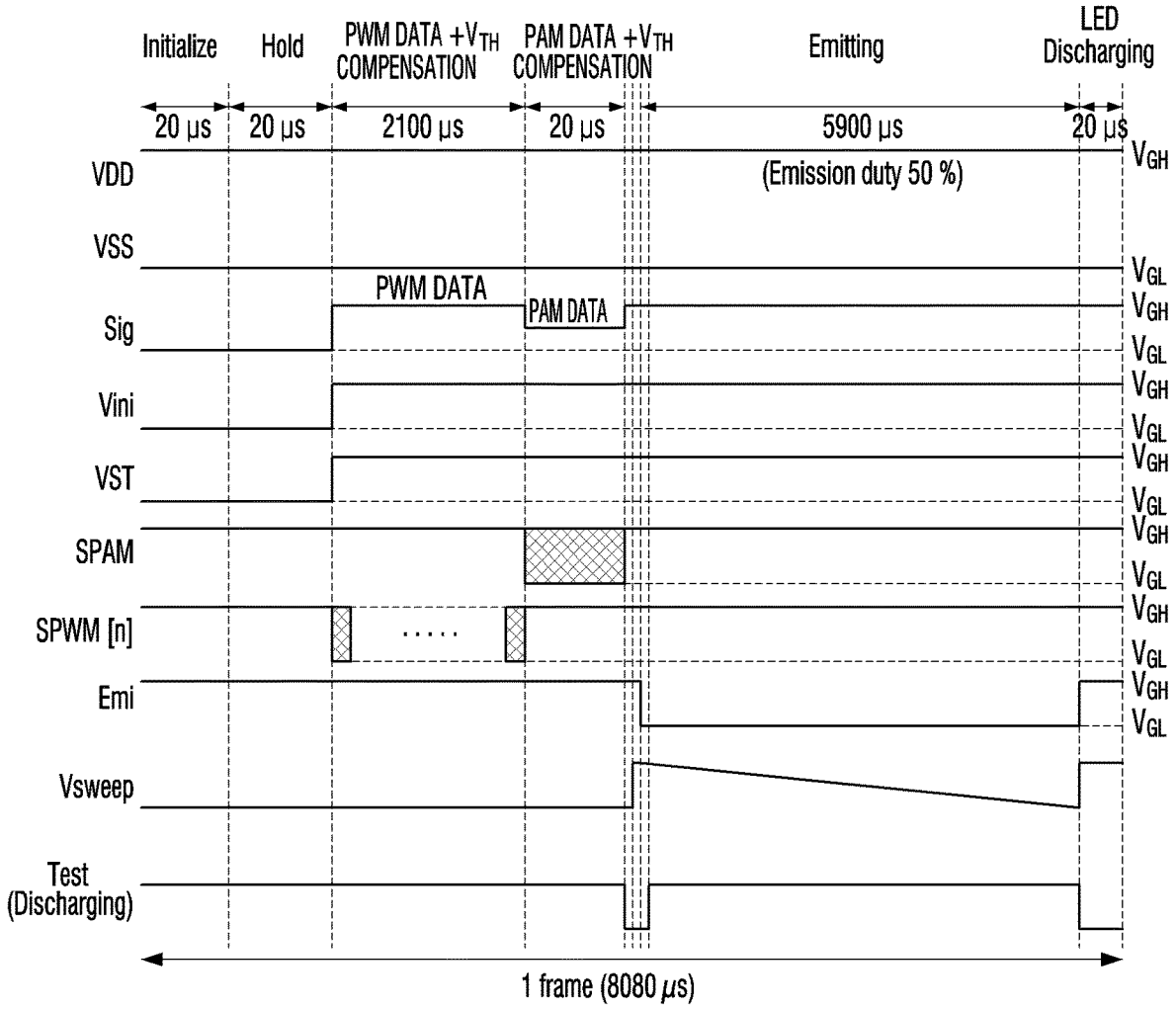
FIG. 17 is a timing diagram of various signals for driving the pixel circuit of FIG. 16 according to an embodiment.

FIG. 17 illustrates a timing diagram of various signals for driving the pixel circuit 900 of FIG. 16 according to an embodiment.

Referring to FIG. 17, in order to display one image frame, the PWM pixel circuit 900 may be driven in the order of an initialization period (Initialize), a hold period (Hold), a data voltage setting and threshold voltage Vth compensation period, an emission period (Emitting), and a discharging period (LED Discharging).

In this case, as in the example illustrated in FIG. 17, the data voltage setting and threshold voltage Vth compensation period may include a PAM data voltage setting and a threshold voltage compensation period of the transistor T3 (PWM data+Vth compensation) and a PAM data voltage setting and a threshold voltage compensation period of the transistor T8 (PAM data+Vth compensation).

The initialization period is a period for initializing the voltages of the gate terminals C and A of the first transistor T8 and the fourth transistor T3. The PWM pixel circuit 900 initializes the voltages of the C and A terminals to the initial voltage Vini in the initialization period.

Specifically, in the initialization period, because the eleventh transistor T11 and the twelfth transistor T12 are turned on according to the control signal VST, the initial voltage Vini is applied to the gate terminal C of the first transistor T8 through the eleventh transistor T11, and is applied to the gate terminal A of the fourth transistor T3 through the twelfth transistor T12.

The hold period is a period for continuously holding the voltages of the gate terminal C of the first transistor T8 and the gate terminal A of the fourth transistor T3 in a low state (that is, an initialized state). This is because the first transistor T8 and the fourth transistor T3 should be turned on when the data voltage setting and threshold voltage Vth compensation period starts.

The data voltage setting and threshold voltage compensation period is a period for setting the data voltages in the PWM driving circuit 910 and the PAM driving circuit 920, respectively, and compensating the threshold voltages Vth of the first transistor T8 and the fourth transistor T3.

According to an embodiment, as illustrated in FIG. 17, the PWM data voltage setting and threshold voltage compensation of the fourth transistor T3 may be performed first, and then the PAM data voltage setting and threshold voltage compensation of the first transistor T8 may be performed. It is understood, however, that another embodiment is not limited thereto, and the order may be changed.

Meanwhile, during the data voltage setting and threshold voltage compensation period, all of the seventh to tenth transistors T1, T5, T6, and T10 are turned off according to the control signal Emi, and therefore, the PWM driving circuit 910 and the PAM driving circuit 920 are each independently configured to perform the data voltage setting and threshold voltage compensation.

First, the PWM data voltage setting and threshold voltage compensation period of the fourth transistor T3 (PWM data+Vth compensation) is a section in which the PWM data voltage transmitted through a data line (Sig wiring) is applied to the gate terminal A of the fourth transistor T3.

Specifically, if the fifth transistor T4 and the sixth transistor T2 are turned on according to the control signal SPWM(n), the PWM data voltage passes through the sixth transistor T2, the fourth transistor T3, and the fifth transistor T4 in turn, and a compensated voltage (voltage equal to the sum of the PWM data voltage and the threshold voltage of the fourth transistor T3) is input to a node A. Accordingly, the compensated voltage is stored in the first capacitor C1 and the node A holds a floating state.

The control signal SPWM(n) may be a signal output from a gate driver inside or outside the display panel 1000. In SPWM(n), n refers to the number of pixel lines included in the display panel 1000. Accordingly, the PWM data voltage is sequentially applied to the pixels (or sub-pixels) for each line of the plurality of pixels disposed in a matrix form.

The PAM data voltage setting and threshold voltage compensation period of the first transistor T8 (PAM data+Vth compensation) is a section in which the PAM data voltage transmitted through the data line (Sig wiring) is applied to the gate terminal C of the first transistor T8.

Specifically, during the PAM data voltage setting and threshold voltage compensation period of the first transistor T8, because the control signal SPAM is low, the second transistor T9 and the third transistor T7 are turned on.

In this case, similar to the internal compensation principle of the PWM driving circuit 910 described above, because the PAM data voltage is input to a node C through the third transistor T7, the first transistor T8, and the second transistor T9, a voltage equal to the sum of the PAM data voltage and the threshold voltage of the first transistor T8 is input to the node C. The compensated voltage is stored in the second capacitor C2 and the node C holds a floating state.

The control signal SPAM may be a signal output from a gate driver inside or outside the display panel 1000. According to an embodiment, unlike the control signal SPWM(n), the control signal SPAM may be collectively applied to the pixels (or sub-pixels) included in the display panel 1000. In this case, according to an embodiment, the PAM data voltage collectively applied to the sub-pixels included in the display panel 1000 may be a voltage of the same magnitude. However, the PAM data voltage is not limited thereto.

The emission period (Emitting) is a section in which the light emitting element 100 emits light. During the emission period, the light emitting element 100 emits light according to the amplitude and pulse width of the driving current provided by the PWM driving circuit 900, thereby expressing the gray scales corresponding to the applied PAM data voltage and PWM data voltage.

Specifically, during the emission period, because the seventh to tenth transistors T1, T5, T6, and T10 are turned on according to the control signal Emi, the PWM driving circuit 910 and the PAM driving circuit 920 are electrically connected to each other, and are also electrically connected to the driving voltage terminal and the light emitting element 100.

In a case in which the emission period starts, because the driving voltage VDD is transmitted to the light emitting element 100 through the seventh transistor T1, the ninth transistor T6, the first transistor T8, and the tenth transistor T10, a potential difference occurs at both ends of the light emitting element 100 so that the light emitting element 100 starts emitting light. In this case, the driving current for emitting the light has an amplitude corresponding to the PAM data voltage.

Further, before the emission period (specifically, a time section before the seventh to tenth transistors T1, T5, T6, and T10 are turned on according to the control signal Emi after the application of the PAM data voltage is completed), a sweep voltage Vsweep that is stepped up from the initial voltage value by a specific voltage value is applied to the first capacitor C1. In this case, a coupling voltage is generated at the gate terminal A of the fourth transistor T3 in the floating state through the first capacitor C1. Accordingly, the voltage of the node A increases by the stepped-up sweep voltage from a voltage equal to the sum of the PWM data voltage and the threshold voltage of the fourth transistor T3.

Then, when the emission period starts, the sweep voltage gradually decreases to an initial voltage value, and accordingly, the voltage of the node A also decreases according to the sweep voltage. When the voltage of the node A, which has decreased, reaches a voltage value obtained by summing the threshold voltage of the fourth transistor T3 and the driving voltage VDD applied to the source terminal of the fourth transistor T3 through the turned on seventh transistor T1, the fourth transistor T3 is turned on from the off state.

When the fourth transistor T3 is turned on, the driving voltage VDD is transferred to the gate terminal C of the first transistor T8 through the seventh transistor T1, the fourth transistor T3, and the eighth transistor T5. When the driving voltage VDD is applied to the gate terminal C of the first transistor T8, the first transistor T8 is turned off. When the first transistor T8 is turned off, the driving voltage VDD does not reach the light emitting element 100, and therefore, light emission of the light emitting element 100 is terminated.

As such, until the voltage applied to the gate terminal A of the fourth transistor T3 changes according to the sweep voltage Vsweep to become a voltage value obtained by adding the driving voltage VDD and the threshold voltage of the fourth transistor T3 since the driving voltage VDD is applied to the light emitting element 100, the PWM driving circuit 910 provides the driving current to the light emitting element 100. That is, the driving current has a pulse width corresponding to the PWM data voltage.

According to an embodiment, in order to discharge a leakage current, the first pixel circuit 900 may turn on a transistor connected in parallel with a first inorganic light emitting element in a time section including a time point at which a switching operation of the transistor is performed.

Specifically, during the time section from a preset time point before a time point at which the seventh to tenth transistors T1, T5, T6, and T10 are turned on according to the control signal Emi to a predetermined time point thereafter, the thirteenth transistor T13 may be turned on according to a control signal Discharging.

This is for luminance of the light emitting element 100 to be 0 nits, when discharging the leakage current to the ground voltage VSS terminal through the thirteenth transistor T13 to drive the light emitting element 100 to express a low gray scale, in particular, black.

Specifically, in the case of expressing black using the light emitting element 100, if the seventh to tenth transistors T1, T5, T6, and T10 are turned on by the control signal Emi, the fourth transistor T3 is turned on, and accordingly, the first transistor T8 is turned off, so that the driving current does not flow through the light emitting element 100 during the emission period.

However, in this case, due to the lack of discharge capability of the node C, a time difference occurs between a time point at which the fourth transistor T3 is turned on and a time point at which the first transistor T8 is turned off, and input resistance of the circuit applying the driving voltage VDD and internal resistance of the PWM pixel circuit 900 are high. Therefore, the leakage current occurring between the time point at which the fourth transistor T3 is turned on and the time point at which the first transistor T8 is turned off may flow through the light emitting element 100.

In this case, because the light emitting element 100 emits light minutely (that is, light leakage occurs), a problem of not reproducing black (i.e., perfect black) using the light emitting element 100 may occur.

Accordingly, according to an embodiment, during the time section from the preset time point before the time point at which the seventh to tenth transistors T1, T5, T6, and T10 are turned on according to the control signal Emi to the predetermined time point thereafter, the thirteenth transistor T13 may be turned on using the control signal Discharging to discharge the leakage current through the thirteenth transistor T13. As such, the leakage current may be prevented from flowing through the light emitting element 100, and black may be expressed using the light emitting element 100.

That is, according to an embodiment, the luminance of the light emitting element 100 may be 0 nits at the time of expressing black by discharging the leakage current generated by the RC load of the circuit to which the driving voltage VDD is applied and the transistor characteristic change due to a process variation of the transistor through the thirteenth transistor T13 when expressing a black color through the light emitting element 100.

Further, even after the light emission of the light emitting element 100 is terminated, there may be a charge remaining in the light emitting element 100. This may cause a problem that the light emitting element 100 emits light minutely after the light emission is terminated, which may be particularly problematic when expressing the low gray scale (e.g., black).

Accordingly, the discharging period (LED Discharging) is a period for discharging the charge remaining in the light emitting element 100 after the light emission period is terminated, and the PWM pixel circuit 900 may solve the above-described problem by completely discharging the charge remaining in the light emitting element 100 to the ground voltage VSS terminal by turning on the thirteenth transistor T13 according to the control signal Discharging.

As described above, before the light emitting element 100 is mounted on the TFT layer and electrically connected to the PWM pixel circuit 900, the thirteenth transistor T13 may be used to check whether the PWM pixel circuit 900 is abnormal. For example, the developer or manufacturer of the product may check whether the PWM pixel circuit 900 is abnormal (for example, short or open of a circuit) by turning on the eleventh transistor T11 through the control signal Test during the emission period, and then checking the current flowing through the eleventh transistor T11.

Moreover, the various data signals Sig, the driving voltage VDD, the ground voltage VSS, and the control signals (Vsweep, Emi, SPWM(n), SPAM, Vini, VST, and Test/Discharging) illustrated in FIG. 17 may be received from at least one of an external timing controller (TCON), a processor, a power supply circuit, a sweep signal providing circuit, a driver circuit (for example, a data driver, a gate driver), or the like.

Figure 18:
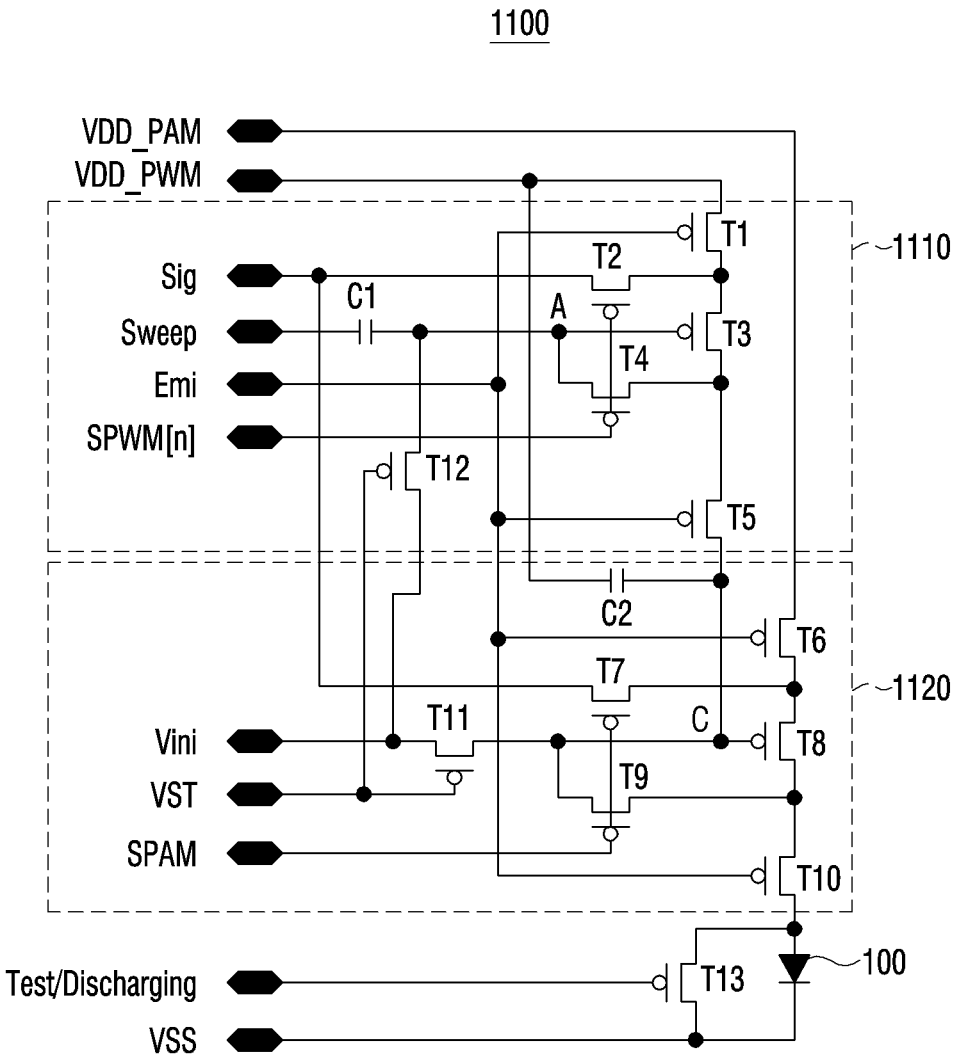
FIG. 18 is a detailed circuit diagram of a pixel circuit according to an embodiment.

FIG. 18 is a detailed circuit diagram of a pixel circuit 1100 according to an embodiment. First, the elements constituting a first pixel circuit 1100 and a connection relation between the elements will be described with reference to FIG. 18. For reference, the pixel circuit 1100 illustrated in FIG. 18 is the same as the pixel circuit 1100 illustrated in FIG. 10.

FIG. 18 illustrates a circuit associated with one sub-pixel, that is, one light emitting element 100 and a PWM pixel circuit 1100 for driving the one light emitting element 100.

Referring to FIG. 18, the PWM pixel circuit 1100 may include a PWM driving circuit 1110 and a PAM driving circuit 1120.

Specifically, the PAM driving circuit 1120 includes a first transistor T8, a second transistor T9 connected between a drain terminal and a gate terminal of the first transistor T8, and a third transistor T7 having a drain terminal connected to a source terminal of the first transistor T8 and a gate terminal connected to a gate terminal of the second transistor T9, and receiving a data signal Sig (that is, a PAM data voltage) through a source terminal.

If (e.g., based on) the PAM data voltage is applied through the source terminal of the third transistor T7 while the second transistor T9 and the third transistor T7 are turned on according to a control signal SPAM, the PAM driving circuit 1120 applies to the gate terminal of the first transistor T8 by a voltage equal to the sum of the applied PAM data voltage and a threshold voltage of the first transistor T8 through the first transistor T8 and the second transistor T9 that are turned on.

Meanwhile, the PWM driving circuit 1110 includes a fourth transistor T3, a fifth transistor T4 connected between a drain terminal and a gate terminal of the fourth transistor T3, and a sixth transistor T2 having a drain terminal connected to a source terminal of the fourth transistor T3 and a gate terminal connected to a gate terminal of the fifth transistor T4, and receiving a data signal Sig (that is, a PWM data voltage) through a source terminal.

If (e.g., based on) the PWM data voltage is applied through the source terminal of the sixth transistor T2 while the fifth transistor T4 and the sixth transistor T2 are turned on according to a control signal SPWM(n), the PWM driving circuit 1110 applies to the gate terminal A of the fourth transistor T3 by a voltage equal to the sum of the applied PWM data voltage and a threshold voltage of the fourth transistor T3 through the fourth transistor T3 and the fifth transistor T4 that are turned on.

A seventh transistor T1 has a source terminal connected to a PWM driving voltage terminal (or a driving voltage signal) VDD_PWM of the PWM pixel circuit 1100, and a drain terminal that is commonly connected to the drain terminal of the sixth transistor T2 and the source terminal of the fourth transistor T3. The seventh transistor T1 is turned on/off by a control signal Emi to electrically connect or disconnect the PWM driving voltage terminal VDD_PWM and the PWM driving circuit 1110.

An eighth transistor T5 has a source terminal connected to the drain terminal of the fourth transistor T3 and a drain terminal connected to the gate terminal of the first transistor T8. The eighth transistor T5 is turned on/off according to the control signal Emi to electrically connect or disconnect the PWM driving circuit 1110 and the PAM driving circuit 1120.

A ninth transistor T6 has a source terminal connected to a PAM driving voltage terminal VDD_PAM of the PWM pixel circuit 1100, and a drain terminal that is commonly connected to the source terminal of the first transistor T8 and the drain terminal of the third transistor T7. The ninth transistor T6 is turned on/off by the control signal Emi to electrically connect or disconnect the PAM driving voltage terminal VDD_PAM and the PAM driving circuit 1120.

A tenth transistor T10 has a source terminal connected to the drain terminal of the first transistor T8, and a drain terminal connected to an anode terminal of the light emitting element 100. The tenth transistor T10 is turned on/off according to the control signal Emi to electrically connect or disconnect the PAM driving circuit 1120 and the light emitting element 100.

A first capacitor C1 has one end commonly connected to the gate terminal of the fourth transistor T3 and the drain terminal of the fifth transistor T4, and the other end to which a sweep voltage (i.e., Vsweep) is applied.

An eleventh transistor T11 has a drain terminal commonly connected to the gate terminal of the first transistor T8 and the drain terminal of the second transistor T9, and a source terminal to which an initial voltage Vini is applied.

A twelfth transistor T12 has a source terminal connected to one end of the first capacitor C1 and a drain terminal connected to the source terminal of the eleventh transistor T11.

The second capacitor C2 has one end connected to the PWM driving voltage terminal VDD_PWM, and the other end commonly connected to the gate terminal of the first transistor T8, the drain terminal of the second transistor T9, the drain terminal of the eleventh transistor T11, and the drain terminal of the eighth transistor T5.

The eleventh transistor T11 and the twelfth transistor T12 are turned on according to a control signal VST to apply the initial voltage Vini to the gate terminal C of the first transistor T8 and the gate terminal A of the fourth transistor T3.

In order to prevent the PWM driving voltage VDD_PWM from being coupled to the gate terminal C of the first transistor T8 through the second capacitor C2 after the voltages of the gate terminal C of the first transistor T8 and the gate terminal A of the fourth transistor T3 are initialized, the eleventh transistor T11 and the twelfth transistor T12 remain in the on state according to the control signal VST for a predetermined time even after the PWM driving voltage VDD_PWM is applied to one end of the second capacitor C2 to apply the initial voltage Vini to the gate terminals C and A of the first transistor T8 and the fourth transistor T3.

A thirteenth transistor T13 is connected between the anode terminal and a cathode terminal of the light emitting element 100.

Before the light emitting element 100 is mounted on the TFT layer and electrically connected to the PWM pixel circuit 900, the thirteenth transistor T13 may be turned on according to a control signal Test to check whether the PWM pixel circuit 900 is abnormal. In addition, after the light emitting element 100 is mounted on the TFT layer and electrically connected to the PWM pixel circuit 900, the thirteenth transistor T13 may be turned on according to a control signal Discharging to discharge the charge remaining in the light emitting element 100.

Further, the cathode terminal of the light emitting element 100 is connected to a ground voltage VSS terminal.

Hereinafter, an operation of the PWM pixel circuit 1100 is described in more detail with reference to FIG. 19.

Figure 19:
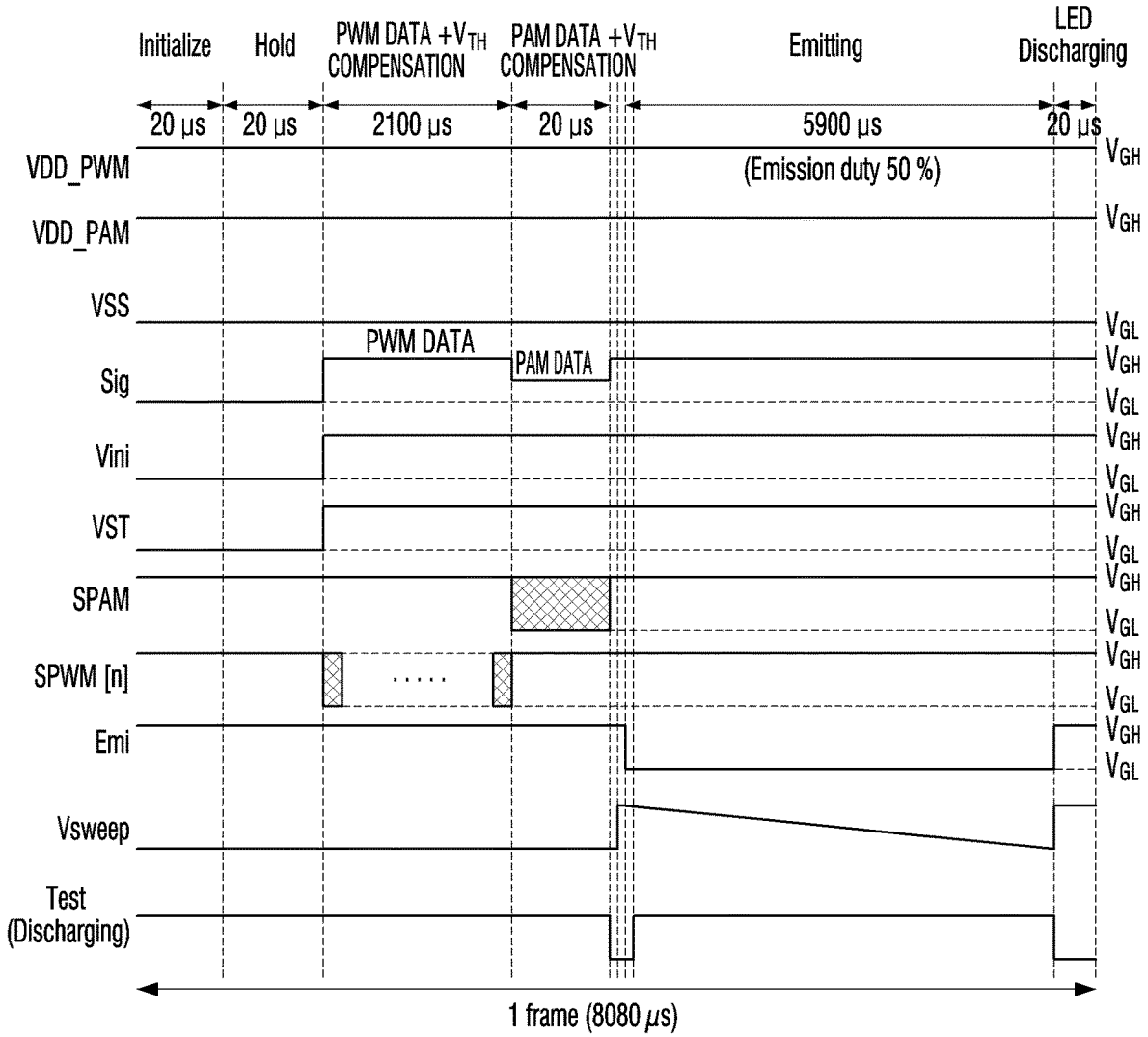
FIG. 19 is a timing diagram of various signals for driving the pixel circuit of FIG. 18 according to an embodiment.

FIG. 19 illustrates a timing diagram of various signals for driving the pixel circuit 1100 of FIG. 18 according to an embodiment.

Referring to FIG. 19, in order to display one image frame, the PWM pixel circuit 1100 may be driven in the order of an initialization period (Initialize), a hold period (Hold), a data voltage setting and threshold voltage Vth compensation period, an emission period (Emitting), and a discharging period (LED Discharging).

In this case, as in the example illustrated in FIG. 19, the data voltage setting and threshold voltage Vth compensation period may include a PAM data voltage setting and a threshold voltage compensation period of the transistor T3 (PWM data+Vth compensation) and a PAM data voltage setting and a threshold voltage compensation period of the transistor T8 (PAM data+Vth compensation).

The initialization period is a period for initializing the voltages of the gate terminal C of the first transistor T8 and the gate terminal A of the fourth transistor T3. The PWM pixel circuit 1100 initializes the voltages of the C and A terminals to the initial voltage Vini in the initialization period.

Specifically, in the initialization period, because the eleventh transistor T11 and the twelfth transistor T12 are turned on according to the control signal VST, the initial voltage Vini is applied to the gate terminal C of the first transistor T8 through the eleventh transistor T11, and is applied to the gate terminal A of the fourth transistor T3 through the twelfth transistor T12.

The hold period is a period for continuously holding the voltages of the gate terminal C of the first transistor T8 and the gate terminal A of the fourth transistor T3 in a low state (that is, an initialized state). This is because the first transistor T8 and the fourth transistor T3 should be turned on when the data voltage setting and threshold voltage Vth compensation period starts.

The data voltage setting and threshold voltage compensation period is a period for setting the data voltages in the PWM driving circuit 1110 and the PAM driving circuit 1120, respectively, and compensating the threshold voltages Vth of the first transistor T8 and the fourth transistor T3.

According to an embodiment, as illustrated in FIG. 19, the PWM data voltage setting and threshold voltage compensation of the fourth transistor T3 may be performed first, and then the PAM data voltage setting and threshold voltage compensation of the first transistor T8 may be performed. However, it is understood that one or more other embodiments are not limited thereto, and the order may be changed.

Meanwhile, during the data voltage setting and threshold voltage compensation period, all of the seventh to tenth transistors T1, T5, T6, and T10 are turned off according to the control signal Emi, and therefore, the PWM driving circuit 1110 and the PAM driving circuit 1120 are each independently configured to perform the data voltage setting and threshold voltage compensation.

First, the PWM data voltage setting and threshold voltage compensation period of the fourth transistor T3 (PWM data+Vth compensation) is a section in which the PWM data voltage transmitted through a data line (Sig wiring) is applied to the gate terminal A of the fourth transistor T3.

Specifically, if the fifth transistor T4 and the sixth transistor T2 are turned on according to the control signal SPWM(n), the PWM data voltage passes through the sixth transistor T2, the fourth transistor T3, and the fifth transistor T4 in turn, and a compensated voltage (voltage equal to the sum of the PWM data voltage and the threshold voltage of the fourth transistor T3) is input to a node A. Accordingly, the compensated voltage is stored in the first capacitor C1 and the node A holds a floating state.

The control signal SPWM(n) may be a signal output from a gate driver inside or outside the display panel 1000. In SPWM(n), n refers to the number of pixel lines included in the display panel 1000. Accordingly, the PWM data voltage is sequentially applied to the pixels (or sub-pixels) for each line of the plurality of pixels disposed in a matrix form.

The PAM data voltage setting and threshold voltage compensation period of the first transistor T8 (PAM data+Vth compensation) is a section in which the PAM data voltage transmitted through the data line (Sig wiring) is applied to the gate terminal C of the first transistor T8.

Specifically, during the PAM data voltage setting and threshold voltage compensation period of the first transistor T8, because the control signal SPAM is low, the second transistor T9 and the third transistor T7 are turned on.

In this case, similar to the internal compensation principle of the PWM driving circuit 910 described above, because the PAM data voltage is input to a C node through the third transistor T7, the first transistor T8, and the second transistor T9, a voltage equal to the sum of the PAM data voltage and the threshold voltage of the first transistor T8 is input to the C node. The compensated voltage is stored in the second capacitor C2 and the node C holds a floating state.

Further, the control signal SPAM may be a signal output from a gate driver inside or outside the display panel 1000. According to an embodiment, unlike the control signal SPWM(n), the control signal SPAM may be collectively applied to the pixels (or sub-pixels) included in the display panel 1000. In this case, according to an embodiment, the PAM data voltages collectively applied to the sub-pixels included in the display panel 1000 may be voltages of the same magnitude. However, the PAM data voltage is not limited thereto.

The emission period is a section in which the light emitting element 100 emits light. During the emission period, the light emitting element 100 emits light according to the amplitude and pulse width of the driving current provided by the PWM pixel circuit 1100, thereby expressing the gray scales corresponding to the applied PAM data voltage and PWM data voltage.

Specifically, during the emission period, because the seventh to tenth transistors T1, T5, T6, and T10 are turned on according to the control signal Emi, the PWM driving circuit 1110 and the PAM driving circuit 1120 are electrically connected to each other, and are also electrically connected to the driving voltage terminals VDD_PWM and VDD_PAM and the light emitting element 100.

In a case in which the emission period starts, because the PAM driving voltage VDD_PAM is transmitted to the light emitting element 100 through the ninth transistor T6, the first transistor T8, and the tenth transistor T10, a potential difference occurs at both ends of the light emitting element 100 so that the light emitting element 100 starts emitting light. In this case, the driving current for emitting the light has amplitude corresponding to the PAM data voltage.

Before the emission period (specifically, a time section before the seventh to tenth transistors T1, T5, T6, and T10 is turned on according to the control signal Emi after the application of the PAM data voltage is completed), a sweep voltage Vsweep that is stepped up from the initial voltage value by a specific voltage value is applied to the first capacitor C1. In this case, a coupling voltage is generated at the gate terminal A of the fourth transistor T3 in the floating state through the first capacitor C1. Accordingly, the voltage of the node A increases by the stepped-up sweep voltage from a voltage equal to the sum of the PWM data voltage and the threshold voltage of the fourth transistor T3.

Then, when the emission period starts, the sweep voltage gradually decreases to an initial voltage value and, accordingly, the voltage of the node A also decreases according to the sweep voltage. When the voltage of the node A, which has decreased, reaches a voltage value obtained by summing the threshold voltage of the fourth transistor T3 and the PWM driving voltage VDD_PWM applied to the source terminal of the fourth transistor T3 through the turned on seventh transistor T1, the fourth transistor T3 is turned on from the off state.

When the fourth transistor T3 is turned on, the PWM driving voltage VDD_PWM is transferred to the gate terminal C of the first transistor T8 through the seventh transistor T1, the fourth transistor T3, and the eighth transistor T5. When the PWM driving voltage VDD_PWM is applied to the gate terminal C of the first transistor T8, the first transistor T8 is turned off. When the first transistor T8 is turned off, the driving voltage VDD does not reach the light emitting element 100, and therefore, light emission of the light emitting element 100 is terminated.

As such, until the voltage applied to the gate terminal A of the fourth transistor T3 changes according to the sweep voltage Vsweep to become a voltage value obtained by adding the PWM driving voltage VDD_PWM and the threshold voltage of the fourth transistor T3 since the PWM driving voltage VDD_PWM is applied to the light emitting element 100, the PWM driving circuit 1110 provides the driving current to the light emitting element 100. That is, the driving current has a pulse width corresponding to the PWM data voltage.

According to an embodiment, the first pixel circuit 1100 may turn on a transistor connected in parallel with a first inorganic light emitting element in a time section including a time point at which a switching operation of the transistor is performed, in order to discharge a leakage current.

Specifically, during the time section from a preset time point before a time point at which the seventh to tenth transistors T1, T5, T6, and T10 are turned on according to the control signal Emi to a predetermined time point thereafter, the thirteenth transistor T13 may be turned on according to a control signal Discharging.

This is for luminance of the light emitting element 100 to be 0 nits, when discharging the leakage current to the ground voltage VSS terminal through the thirteenth transistor T13 to drive the light emitting element 100 to express a low gray scale, in particular, black.

Specifically, in the case of expressing black using the light emitting element 100, if the seventh to tenth transistors T1, T5, T6, and T10 are turned on by the control signal Emi, the fourth transistor T3 is turned on and, accordingly, the first transistor T8 is turned off, so that the driving current does not flow through the light emitting element 100 during the emission period.

However, in this case, due to the lack of discharge capability of the node C, a time difference occurs between a time point at which the fourth transistor T3 is turned on and a time point at which the first transistor T8 is turned off, and input resistance of the circuit applying the PWM driving voltage VDD_PWM and internal resistance of the PWM pixel circuit 1100 are high. Therefore, the leakage current occurring between the time point at which the fourth transistor T3 is turned on and the time point at which the first transistor T8 is turned off may flow through the light emitting element 100.

In this case, because the light emitting element 100 emits light minutely (that is, light leakage occurs), a problem of not reproducing black (i.e., perfect black) using the light emitting element 100 may occur.

According to an embodiment, during the time section from the preset time point before the time point at which the seventh to tenth transistors T1, T5, T6, and T10 are turned on according to the control signal Emi to the predetermined time point thereafter, the thirteenth transistor T13 may be turned on using the control signal Discharging to discharge the leakage current through the thirteenth transistor T13. Accordingly, the leakage current may be prevented from flowing through the light emitting element 100, and black may be expressed using the light emitting element 100.

As such, according to an embodiment, the luminance of the light emitting element 100 may be 0 nits at the time of expressing black by discharging the leakage current generated by the RC load of the circuit to which the PWM driving voltage VDD_PWM is applied and the transistor characteristic change due to a process variation of the transistor through the thirteenth transistor T13 when expressing a black color through the light emitting element 100.

Even after the light emission of the light emitting element 100 is terminated, there may be a charge remaining in the light emitting element 100. This may cause a problem that the light emitting element 100 emits light minutely after the light emission is terminated, which may be particularly problematic when expressing the low gray scale (e.g., black).

Accordingly, the discharging period (LED Discharging) is a period for discharging the charge remaining in the light emitting element 100 after the light emission period is terminated, and the PWM pixel circuit 1100 may solve the above-described problem by completely discharging the charge remaining in the light emitting element 100 to the ground voltage VSS terminal by turning on the thirteenth transistor T13 according to the control signal Discharging.

Further, as described above, before the light emitting element 100 is mounted on the TFT layer and electrically connected to the PWM pixel circuit 1100, the thirteenth transistor T13 may be used to check whether the PWM pixel circuit 1100 is abnormal. For example, the developer or manufacturer of the product may check whether the PWM pixel circuit 1100 is abnormal (for example, short or open of a circuit) by turning on the thirteenth transistor T13 through the control signal Test during the emission period, and then checking the current flowing through the thirteenth transistor T13.

Moreover, the various data signals Sig, the PWM driving voltage VDD_PWM, the PAM driving voltage VDD_PAM, the ground voltage VSS, and the control signals (Vsweep, Emi, SPWM(n), SPAM, Vini, VST, and Test/Discharging) illustrated in FIG. 19 may be received from at least one of an external timing controller (TCON), a processor, a power supply circuit, a sweep signal providing circuit, a driver circuit (for example, a data driver, a gate driver), or the like.

Figure 20:
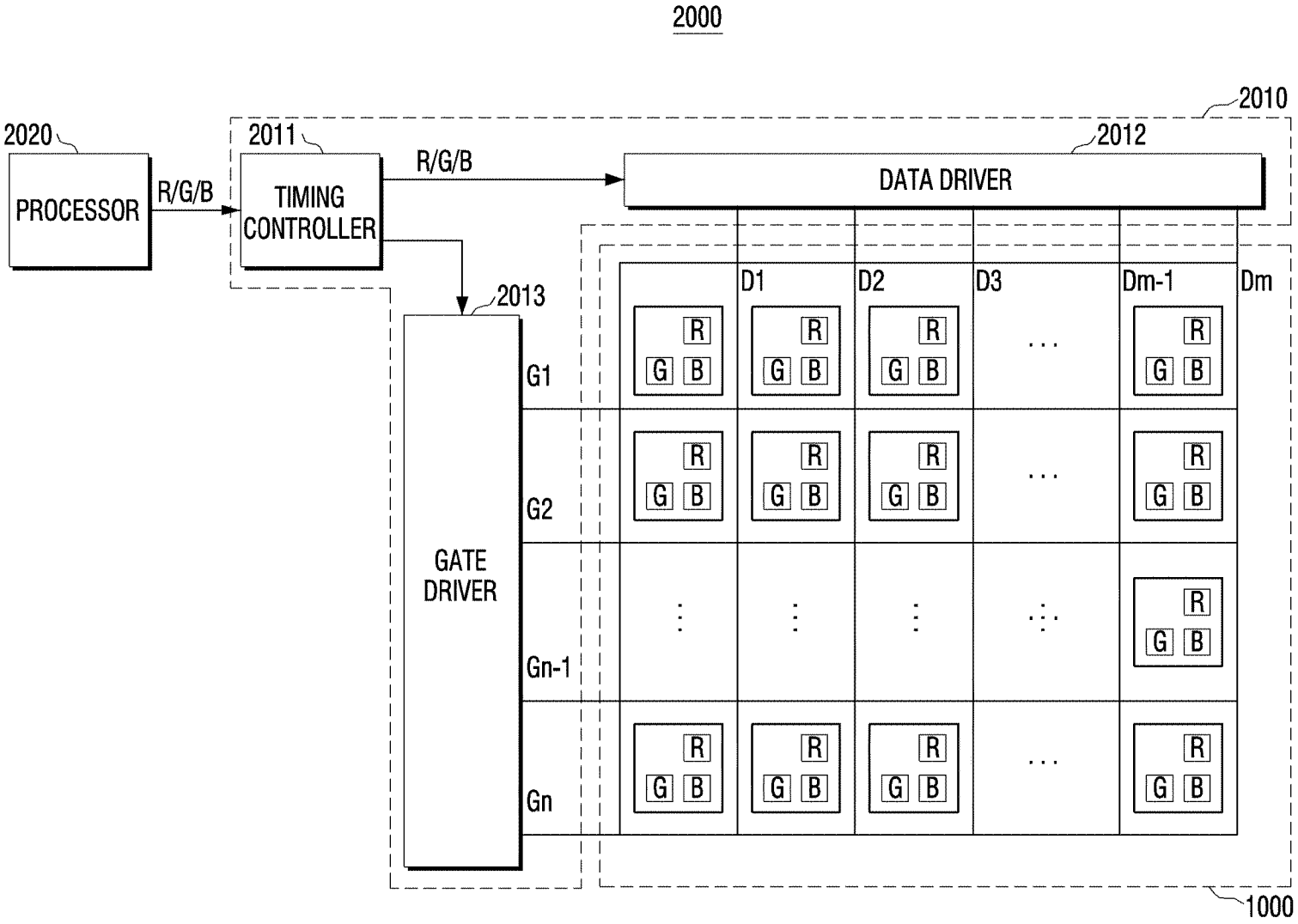
FIG. 20 is a configuration diagram of a display device according to an embodiment.

FIG. 20 is a configuration diagram of a display device 2000 according to an embodiment. Referring to FIG. 20, the display device 2000 includes a display panel 1000, a panel driver 2010, and a processor 2020 (e.g., at least one processor).

The display panel 1000 may include a plurality of pixels, and each pixel may include a plurality of sub-pixels. In this case, each sub-pixel may include a light emitting element 100 and a pixel circuit 200.

In addition, the display panel 1000 may be formed or provided such that gate lines G1 to Gn and data lines D1 to Dm cross each other, and the pixel circuit 200 may be formed or provided in a region provided to cross each other. In this case, the light emitting element may be formed or provided on each pixel circuit. Specifically, an R light emitting element may formed on a pixel circuit for driving the R light emitting element, a G light emitting element may be formed on a pixel circuit for driving the G light emitting element, and a B light emitting element may be formed on a pixel circuit for driving the B light emitting element.

The panel driver 2010 drives the display panel 1000 under the control of the processor 2020, and may include a timing controller 2011, a data driver 2012, and a gate driver 2013.

The timing controller 2011 may receive an input signal IS, a horizontal sync signal Hsync, a vertical sync signal Vsync, a main clock signal MCLK, and the like from the outside to generate an image data signal, a scan control signal, a data control signal, a light emission control signal, and the like and provide them to the display panel 1000, the data driver 2012, the gate driver 2013, a power supply circuit, a sweep signal providing circuit, and the like.

In addition, the timing controller 2011 may apply various control signals to the pixel circuit 200 according to diverse embodiments. In addition, in some embodiments, the timing controller 2011 may also apply a control signal for selecting one of the R, G, and B sub-pixels to the pixel circuit 200 through a mux circuit.

The data driver 2012 generates a data signal, and receives the image data of the R/G/B component from the processor 2020 and generates a data voltage (e.g., a PWM data voltage and a PAM data voltage). In addition, the data driver 2012 may apply the generated data signal to the display panel 1000.

The gate driver 2013 generates various control signals (e.g., SPAM, SPWM[m], and the like), and transmits the generated various control signals to a specific row (or a specific horizontal line) of the display panel 1000 or to the entire line thereof.

The power supply circuit may provide a driving voltage VDD to the pixel circuit 200 included in the display panel 1000. In the case of the PWM pixel circuit, in some embodiments, the power supply circuit may provide the driving voltage VDD to the PWM pixel circuit through one line, or the PWM driving voltage VDD_PWM to the PWM driving circuit through one line, and may provide the PAM driving voltage VDD_PAM to the PAM driving circuit through another line.

The sweep signal providing circuit may provide a sweep voltage to the pixel circuit 200 (specifically, the PWM pixel circuit) included in the display panel 1000. In this case, the sweep voltage may have a voltage waveform that is stepped up from the initial voltage and decreases in the form of a triangular waveform.

Further, as described above, the data driver 2012 and the gate driver 2013 may be implemented such that all or a portion of the data driver 2012 and the gate driver 2013 are included in the driving circuit layer 40 formed or provided on one surface of the substrate 30 of the display panel 1000 or may be implemented as separate semiconductor ICs and disposed on the other surface of the substrate 30. The sweep signal providing circuit and the power supply circuit may be implemented in the form of a chip, and are mounted on an external printed circuit board (PCB) together with the processor 2020 or the timing controller 2011, and may be connected to the pixel circuit through the wiring.

However, this is merely an example and it is understood that one or more other embodiments are not limited thereto. For example, at least one of the sweep signal providing circuit, the power supply circuit, and the data driver 2012 may be mounted on the external PCB, and the gate driver 2013 may be included in the TFT layer of the display panel 1000.

The processor 2020 controls an overall operation of the display device 2000. In particular, the processor 2020 may drive the display panel 1000 by controlling the panel driver 2010 to allow the pixel circuit 200 to perform the above-described operations.

To this end, the processor 2020 may be implemented as one or more of a central processing unit (CPU), a microcontroller, an application processor (AP), a communication processor (CP), and an ARM processor.

While in FIG. 20, the processor 2020 and the timing controller 2011 are described as separate components, it is understood that one or more other embodiments are not limited thereto. For example, according to another embodiment, the timing controller 2011 may also perform the function of the processor 2020 without the processor 2020.

Figure 21:
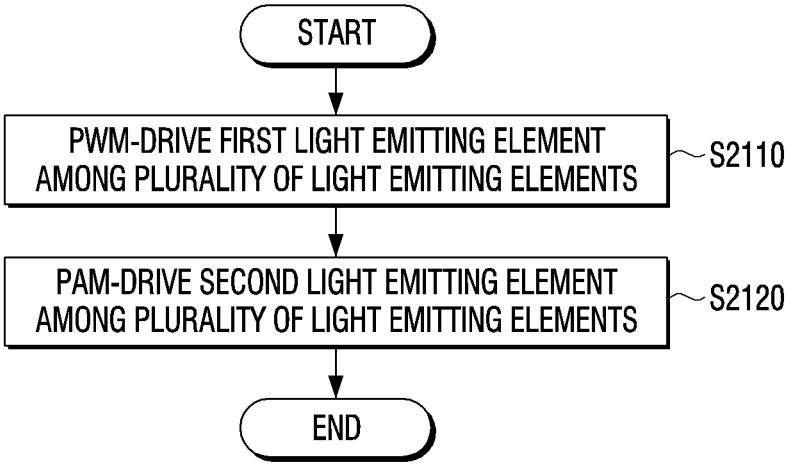
FIG. 21 is a flowchart illustrating a driving method of the display panel according to an embodiment.

FIG. 21 is a flow chart for describing a driving method of a display panel according to an embodiment.

First, in the display panel, each of the plurality of pixels may include a plurality of light emitting elements, and may include a plurality of pixel circuits for driving the plurality of light emitting elements.

A first light emitting element among the plurality of light emitting elements is pulse width modulation (PWM)-driven through a first pixel circuit (operation S2110).

A second light emitting element among the plurality of light emitting elements is pulse amplitude modulation (PAM)-driven through a second pixel circuit (operation S2120).

In this case, the plurality of light emitting elements may include a red (R) light emitting element, a green (G) light emitting element, and a blue (B) light emitting element. Further, the first light emitting element may include the green light emitting element, and the second light emitting element may include the red light emitting element and the blue light emitting element.

Meanwhile, a size of the first pixel circuit may be larger than the size of the second pixel circuit.

Each of the plurality of light emitting elements may emit light based on a driving current provided from the pixel circuit for driving each light emitting element among the plurality of pixel circuits, the first pixel circuit may provide a first driving current having amplitude corresponding to a PAM data voltage applied to the first pixel circuit to the first light emitting element for a time corresponding to the PWM data voltage applied to the first pixel circuit, and the second pixel circuit may provide a second driving current having amplitude corresponding to a PAM data voltage applied to the second pixel circuit to the second light emitting element.

In this case, a gray scale of light emitted from the first light emitting element may be controlled by a time when the first driving current is provided to the first light emitting element according to the magnitude of the PWM data voltage, and a gray scale of light emitted from the second light emitting element may be controlled by the amplitude of the second driving current according to the magnitude of the PAM data voltage.

Each of the plurality of light emitting elements may be a micro LED.

The first pixel circuit may change a voltage of a terminal of the first pixel circuit according to a sweep voltage applied to the first pixel circuit to provide a driving current having a pulse width corresponding to a PWM data voltage to the first light emitting element. The sweep voltage may be a voltage that is linearly changed from a second voltage after changing from a first voltage to the second voltage.

Specifically, the first pixel circuit may include a transistor and control the pulse width of the driving current by performing a switching operation of the transistor based on a voltage of a gate terminal of the transistor that is changed according to the sweep voltage.

Here, the sweep voltage may be a voltage that is stepped up from the first voltage to the second voltage before an emission time of the first light emitting element, and then decreases with time from the second voltage during the emission time.

In this case, the voltage of the gate terminal of the transistor may increase by a difference between the second voltage and the first voltage as the sweep voltage increases, and decrease from the increased voltage as the sweep voltage decreases. Further, the pulse width of the driving current may be determined based on the time until the decreased voltage of the gate terminal reaches a specific voltage.

Here, the specific voltage may be a voltage determined based on a driving voltage for driving the first pixel circuit.

In addition, the difference between the first voltage and the second voltage may correspond to a range of the PWM data voltage for expressing the gray scale of the light emitted from a first inorganic light emitting element.

Meanwhile, one or more embodiments may be implemented by software including instructions that are stored in machine-readable storage media (e.g., a computer). The machine is an apparatus that invokes the stored instructions from the storage medium and is operable according to the invoked instructions, and may include the display device 2000 according to the disclosed embodiments.

When the instructions are executed by the processor, the processor may perform functions corresponding to the instructions, either directly or using other components under the control of the processor. The instructions may include codes generated or executed by a compiler or an interpreter. The machine-readable storage media may be provided in the form of non-transitory storage media. Here, the term "non-transitory" means that the storage medium does not include a signal and is tangible, but does not distinguish whether data is stored semi-permanently or temporarily in the storage medium.

Methods according to various embodiments may be included and provided in a computer program product. The computer program product may be traded as a product between a seller and a purchaser. The computer program product may be distributed in the form of a machine readable storage media (e.g., a compact disc read only memory (CD-ROM)), or online through an application store (e.g., PLAYSTORE™). In the case of the online distribution, at least a portion of the computer program product may be at least temporarily stored in a storage medium such as a memory of a server of a manufacturer, a server of an application store, or a relay server, or be temporarily generated.

Each of the components (e.g., modules or programs) according to various embodiments may include a single entity or a plurality of entities, and some sub-components of the sub-components described above may be omitted, or other sub-components may be further included. Alternatively or additionally, some components (e.g., modules or programs) may be integrated into one entity to perform the same or similar functions performed by the respective components prior to the integration. The operations performed by the module, the program, or other component, in accordance with various embodiments may be executed in a sequential, parallel, iterative, or heuristic manner, or at least some operations may be executed in a different order or omitted, or other operations may be added.

The above description is merely illustrative of the technical spirit of the disclosure, and various modifications and variations may be made by those skilled in the art without departing from the essential characteristics of the disclosure. In addition, the embodiments described above are not intended to limit the technical spirit of the disclosure, and the scope of the technical spirit of the disclosure is not limited by these embodiments. Therefore, the protection scope of the disclosure is defined by at least the following claims, and all technical spirits within the scope equivalent thereto shall be construed as being included in the scope of the disclosure.

What is claimed is:

1. A display panel including a plurality of pixels, the display panel comprising:

a plurality of light emitting elements configured to constitute each pixel of the plurality of pixels; and a plurality of pixel circuits respectively corresponding to the plurality of light emitting elements and configured to drive the plurality of light emitting elements, wherein the plurality of pixel circuits comprises a first pixel circuit for driving a first light emitting element among the plurality of light emitting elements and a second pixel circuit for driving a second light emitting element among the plurality of light emitting elements, wherein each of the plurality of light emitting elements is configured to emit light based on a driving current provided from a corresponding pixel circuit among the plurality of pixel circuits, and wherein the first pixel circuit is configured to provide, to the first light emitting element, a first driving current based on a pulse width modulation (PWM) data voltage for a pulse width of the first driving current and a first pulse amplitude modulation (PAM) data voltage for an amplitude of the first driving current, and the second pixel circuit is configured to provide, to the second light emitting element, a second driving current based on a second PAM data voltage for an amplitude of the second driving current.

2. The display panel as claimed in claim 1, wherein:

the plurality of light emitting elements comprises a red (R) light emitting element, a green (G) light emitting element, and a blue (B) light emitting element;

the first light emitting element corresponds the green light emitting element; and the second light emitting element corresponds to the red light emitting element and the blue light emitting element.

3. The display panel as claimed in claim 1, wherein a size of the first pixel circuit is greater than a size of the second pixel circuit.

4. The display panel as claimed in claim 1, wherein the first pixel circuit is configured to provide, to the first light emitting element for a time corresponding to the PWM data voltage applied to the first pixel circuit, the first driving current having an amplitude corresponding to the first PAM data voltage applied to the first pixel circuit, and wherein the second pixel circuit is configured to provide, to the second light emitting element, the second driving current having an amplitude corresponding to the second PAM data voltage applied to the second pixel circuit.

5. The display panel as claimed in claim 4, wherein:

a gray scale of light emitted from the first light emitting element is controlled by a time when the first driving current is provided to the first light emitting element according to a magnitude of the PWM data voltage; and a gray scale of light emitted from the second light emitting element is controlled by the amplitude of the second driving current according to a magnitude of the second PAM data voltage.

6. The display panel as claimed in claim 1, wherein each of the plurality of light emitting elements is a micro light emitting diode (LED).

7. The display panel as claimed in claim 1, wherein:

the first pixel circuit is configured to change a voltage of a terminal of the first pixel circuit according to a sweep voltage applied to the first pixel circuit to provide, to the first light emitting element, a driving current having a pulse width corresponding to a PWM data voltage; and the sweep voltage is a voltage that is linearly changed from a second voltage after changing from a first voltage to the second voltage.

8. The display panel as claimed in claim 7, wherein the first pixel circuit comprises a transistor and is configured to control the pulse width of the driving current by performing a switching operation of the transistor based on a voltage of a gate terminal of the transistor that is changed according to the sweep voltage.

9. The display panel as claimed in claim 8, wherein the sweep voltage is a voltage that is stepped up from the first voltage to the second voltage before an emission time of the first light emitting element, and then decreases with time from the second voltage during the emission time.

10. The display panel as claimed in claim 9, wherein:

the voltage of the gate terminal of the transistor increases by a difference between the second voltage and the first voltage as the sweep voltage increases, and decreases from the increased voltage as the sweep voltage decreases; and the pulse width of the driving current is determined based on a time until the decreased voltage of the gate terminal reaches a specific voltage.

11. The display panel as claimed in claim 10, wherein the specific voltage is a voltage determined based on a driving voltage for driving the first pixel circuit.

12. The display panel as claimed in claim 7, wherein the difference between the first voltage and the second voltage corresponds to a range of the PWM data voltage for expressing the gray scale of the light emitted from a first inorganic light emitting element.

13. The display panel as claimed in claim 7, wherein the first pixel circuit is configured to turn on a transistor connected in parallel with a first inorganic light emitting element in a time section including a time point at which a switching operation of the transistor is performed, in order to discharge a leakage current.

14. A driving method of a display panel in which each of a plurality of pixels includes a plurality of light emitting elements and includes a plurality of pixel circuits respectively corresponding to the plurality of light emitting elements for driving the plurality of light emitting elements, the driving method comprising:

driving a first light emitting element among the plurality of light emitting elements through a first pixel circuit; and driving a second light emitting element among the plurality of light emitting elements through a second pixel circuit, wherein each of the plurality of light emitting elements emits light based on a driving current provided from a corresponding pixel circuit among the plurality of pixel circuits, and wherein the first pixel circuit is configured to provide, to the first light emitting element, a first driving current based on a pulse width modulation (PWM) data voltage for a pulse width of the first driving current and a first pulse amplitude modulation (PAM) data voltage for an amplitude of the first driving current, and the second pixel circuit is configured to provide, to the second light emitting element, a second driving current based on a second PAM data voltage for an amplitude of the second driving current.

15. The driving method as claimed in claim 14, wherein:

the plurality of light emitting elements comprises a red (R) light emitting element, a green (G) light emitting element, and a blue (B) light emitting element;

the first light emitting element corresponds to the green light emitting element; and the second light emitting element corresponds to the red light emitting element and the blue light emitting element.

16. The driving method as claimed in claim 14, wherein a size of the first pixel circuit is greater than a size of the second pixel circuit.

17. The driving method as claimed in claim 14, wherein the PWM-driving comprises providing, by the first pixel circuit to the first light emitting element for a time corresponding to the PWM data voltage applied to the first pixel circuit, the first driving current having an amplitude corresponding to the first PAM data voltage applied to the first pixel circuit, and wherein the PAM-driving comprises providing, by the second pixel circuit to the second light emitting element, the second driving current having an amplitude corresponding to the second PAM data voltage applied to the second pixel circuit.

18. The driving method as claimed in claim 17, wherein:

a gray scale of light emitted from the first light emitting element is controlled by a time when the first driving current is provided to the first light emitting element according to a magnitude of the PWM data voltage; and a gray scale of light emitted from the second light emitting element is controlled by the amplitude of the second driving current according to a magnitude of the second PAM data voltage.

19. The driving method as claimed in claim 14, wherein each of the plurality of light emitting elements is a micro LED.

20. The driving method as claimed in claim 14, wherein:

the PWM-driving comprises changing, by the first pixel circuit, a voltage of a terminal of the first pixel circuit according to a sweep voltage applied to the first pixel circuit to provide, to the first light emitting element, a driving current having a pulse width corresponding to a PWM data voltage; and the sweep voltage is a voltage that is linearly changed from a second voltage after changing from a first voltage to the second voltage.

21. The driving method as claimed in claim 20, wherein the PWM-driving further comprises controlling, by the first pixel circuit, the pulse width of the driving current by performing a switching operation of a transistor, of the first pixel circuit, based on a voltage of a gate terminal of the transistor that is changed according to the sweep voltage.

22. The driving method as claimed in claim 21, wherein the sweep voltage is a voltage that is stepped up from the first voltage to the second voltage before an emission time of the first light emitting element, and then decreases with time from the second voltage during the emission time.

23. The driving method as claimed in claim 22, wherein:

the voltage of the gate terminal of the transistor increases by a difference between the second voltage and the first voltage as the sweep voltage increases, and decreases from the increased voltage as the sweep voltage decreases; and the pulse width of the driving current is determined based on a time until the decreased voltage of the gate terminal reaches a specific voltage.

24. The driving method as claimed in claim 23, wherein the specific voltage is a voltage determined based on a driving voltage for driving the first pixel circuit.

25. The driving method as claimed in claim 14, wherein the difference between the first voltage and the second voltage corresponds to a range of the PWM data voltage for expressing the gray scale of the light emitted from a first inorganic light emitting element.

26. The driving method as claimed in claim 14, wherein the PWM-driving comprises turning on, by the first pixel circuit, a transistor connected in parallel with a first inorganic light emitting element in a time section including a time point at which a switching operation of the transistor is performed, in order to discharge a leakage current.

* * * * *